US008857932B2

(12) United States Patent
Kobayashi et al.

(10) Patent No.: US 8,857,932 B2
(45) Date of Patent: Oct. 14, 2014

(54) IMAGE FORMING APPARATUS

(75) Inventors: Takeyuki Kobayashi, Kanagawa (JP); Suguru Masunaga, Kanagawa (JP); Masanori Igarashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 203 days.

(21) Appl. No.: 13/467,418

(22) Filed: May 9, 2012

(65) Prior Publication Data

US 2012/0306950 A1 Dec. 6, 2012

(30) Foreign Application Priority Data

Jun. 3, 2011 (JP) ..... 2011-124958
Dec. 14, 2011 (JP) ..... 2011-273513

(51) Int. Cl.

| | |
|---|---|
| ***B41J 29/38*** | (2006.01) |
| *B41J 2/195* | (2006.01) |
| *B41J 2/17* | (2006.01) |
| *B41J 2/175* | (2006.01) |
| *B41J 29/393* | (2006.01) |

(52) U.S. Cl.

CPC *B41J 2/195* (2013.01); *B41J 29/38* (2013.01); *B41J 2/17566* (2013.01); *B41J 2/17553* (2013.01); *B41J 2/175* (2013.01); *B41J 2/17513* (2013.01)

USPC ..... 347/6; 347/7; 347/84; 347/85

(58) Field of Classification Search

USPC ..... 347/7, 6, 84–85

See application file for complete search history.

(56) References Cited

U.S. PATENT DOCUMENTS

| | | | | |
|---|---|---|---|---|
| 4,314,264 | A * | 2/1982 | Bok et al. | 347/89 |
| 6,137,503 | A * | 10/2000 | Hashimoto et al. | 347/19 |
| 7,325,908 | B2 * | 2/2008 | Katoh et al. | 347/85 |
| 7,540,598 | B2 * | 6/2009 | Hori et al. | 347/86 |
| 7,648,230 | B2 * | 1/2010 | Kachi | 347/85 |
| 7,841,706 | B2 * | 11/2010 | Ishinaga et al. | 347/84 |
| 7,871,158 | B2 * | 1/2011 | Kaneko | 347/86 |
| 8,038,271 | B2 * | 10/2011 | Kubo et al. | 347/85 |
| 8,177,313 | B2 * | 5/2012 | Suzuki et al. | 347/7 |
| 8,523,339 | B2 * | 9/2013 | Tokuno | 347/86 |
| 8,596,736 | B2 * | 12/2013 | Kobayashi et al. | 347/7 |
| 2011/0226340 | A1 * | 9/2011 | Tokuno | 137/1 |
| 2013/0044148 | A1 * | 2/2013 | Kobayashi | 347/6 |
| 2013/0135368 | A1 * | 5/2013 | Kobayashi et al. | 347/7 |

FOREIGN PATENT DOCUMENTS

| | | | | |
|---|---|---|---|---|
| JP | 6-183027 | | 7/1994 | |
| JP | 2001162834 | A * | 6/2001 | B41J 2/175 |
| JP | 2005-14342 | | 1/2005 | |
| JP | 2005-59274 | | 3/2005 | |

(Continued)

*Primary Examiner* — Laura Martin
*Assistant Examiner* — Jeremy Bishop
(74) *Attorney, Agent, or Firm* — Cooper & Dunham LLP

(57) ABSTRACT

An image forming apparatus includes: a print head; a head tank; a carriage; a main tank; a pump; a displaceable member or feeler; a first sensor; a second sensor; a controller to supply an amount of liquid ink corresponding to the displacement difference amount of the feeler to the head tank; and an environmental condition detector. The controller stores the environmental condition when the displacement difference amount is stored; corrects the stored displacement difference amount when a change in a current environmental condition relative to the stored environmental condition is more than a previously set first threshold amount and below a previously set second threshold amount being larger than the first threshold amount; and detects and stores the displacement difference amount again when the change in the current environmental condition relative to the stored environmental condition exceeds the second threshold amount.

13 Claims, 26 Drawing Sheets

(56) References Cited

FOREIGN PATENT DOCUMENTS

| | | | | | |
|---|---|---|---|---|---|
| JP | 2005-138472 | | | 6/2005 | |
| JP | 2007-15153 | | | 1/2007 | |
| JP | 2007-130979 | | | 5/2007 | |
| JP | 2008-132638 | | | 6/2008 | |
| JP | 2008265125 | A | * | 11/2008 | |
| JP | 2009-23092 | | | 2/2009 | |
| JP | 2009-23329 | | | 2/2009 | |
| JP | 2009-274325 | | | 11/2009 | |
| JP | 2011-207206 | | | 10/2011 | |
| WO | WO 2009066540 | A1 | * | 5/2009 | ..... B41J 2/175 |
| WO | WO 2011111759 | A1 | * | 9/2011 | |
| WO | WO 2012023416 | A1 | * | 2/2012 | ..... B41J 2/175 |

* cited by examiner

IMAGE FORMING APPARATUS

CROSS-REFERENCE TO RELATED APPLICATIONS

The present application claims priority from Japanese patent application numbers 2011-124958 and 2011-273513, filed on Jun. 3, 2011 and Dec. 14, 2011, respectively, the entire contents of which are incorporated by reference herein.

BACKGROUND OF THE INVENTION

1. Field of the Invention

The present invention relates to an image forming apparatus, and in particular relates to an image forming apparatus including a recording head or print head to discharge ink droplets and a head tank to supply liquid ink to the print head.

2. Description of the Related Art

As an image forming apparatus such as a printer, a facsimile machine, a copier, a plotter, and a multifunction apparatus combining several of the capabilities of the above devices, an inkjet recording apparatus of a liquid discharging recording method employing a recording head formed of ink droplet discharging head is known.

Such an image forming apparatus has a print head that includes a head tank (which is referred to herein as a sub tank or a buffer tank) for supplying ink to the print head and a negative pressure generating mechanism that generates negative pressure in order to prevent exudation or leaking of the ink from the print head nozzles. The head tank of this type includes an ink container in which the ink is contained; a flexible member or film member to form part of the ink container; the negative pressure generating mechanism including an elastic member to press the flexible member outward; and an openably closable air release mechanism that exposes the interior of the ink container to the air. The ink is supplied from the ink container to the print head.

The head tank includes a displacing member (also known as a detector or a feeler) movable in response to the displacement of the flexible member. When the ink is supplied through air release filling from the main tank to the head tank in which air in the head tank is released, a carriage is moved to a predetermined detecting position (or a fill-up position) and a driver of the air release unit disposed on the apparatus body is operated so that the head tank is released to air, ink filling is performed from a state in which the carriage is moved to a predetermined position, and a position when the detector disposed at the apparatus body detects the displacing member is defined as a fill-up position.

As described above, when the displacing member that displaces in accordance with the amount of ink remaining is disposed at the head tank, and the ink is supplied from the main tank to the head tank, the carriage needs to be moved to a predetermined fill-up position. Supplying ink during printing when the amount of ink remaining inside the head tank becomes short necessitates interruption of the printing operation, which reduces the printing speed.

In such a case, amount of ink consumed of the head tank is calculated by counting the number of discharged ink droplets and the ink supply can be performed from the main tank to the head tank by an amount corresponding to the consumed amount. However, because the fill-up position is not correctly detected, an excess negative pressure due to the supply shortage or an excessively low negative pressure due to the excessive ink supply may be generated. Accordingly, the carriage needs to be positioned at the fill-up position regularly, the air release ink-filling needs to be performed, and the printing operation should be interrupted, thereby reducing the printing speed.

Provision of a detector of the amount of ink remaining or a driver for the air release unit at the side of the carriage and necessary members to control the ink supply to the head tank to be mounted to the carriage increase the weight and size of the carriage, thereby making the entire apparatus larger.

BRIEF SUMMARY OF THE INVENTION

The present invention provides an improved image forming apparatus capable of properly supplying liquid ink to the head tank during printing without degrading the printing performance even by sensing the displacing member that displaces corresponding to the remaining ink amount inside the head tank by the sensor mounted to the apparatus body.

The image forming apparatus according to preferred embodiments of the present invention includes: a print head to discharge liquid droplets; a head tank to contain liquid ink to be supplied to the print head; a carriage to mount the print head and the head tank thereon; a main tank to contain liquid ink to be supplied to the head tank; a pump to convey the liquid ink from the main tank to the head tank; a displacing member displacing in response to a remaining amount of the liquid ink inside the head tank and disposed on the head tank; a first sensor disposed at the carriage and detecting the displacing member at a predetermined first position; a second sensor disposed at the apparatus body and detecting the displacing member at a predetermined second position, the first position is a position in which the remaining ink amount in the head tank is less than the second position, wherein a displacement difference amount corresponding to a displacement amount of the displacing member between the position detected by the first sensor and the position detected by the second sensor is detected and stored; a controller to supply an amount of liquid ink corresponding to the displacement difference amount to the head tank, when the liquid ink is supplied from the main tank to the head tank without using the second sensor after the first sensor detects the displacing member; and an environmental condition detector to detect an environmental condition, in which the apparatus is disposed. The controller of the image forming apparatus is configured to: store the environmental condition when the displacement difference amount was stored; correct the stored displacement difference amount when a change in a current environmental condition relative to the stored environmental condition is more than a first threshold amount previously set and below a second threshold amount previously set being larger than the first threshold amount; and detect and store the displacement difference amount again when the change in the current environmental condition relative to the stored environmental condition exceeds the second threshold amount.

The optimal image forming apparatus further include an ink supply system controller to drive the pump to control ink supply from the main tank to the head tank. The ink supply system controller is so configured to detect and store the displacement difference amount of the feeler in at least either case in which power to the apparatus is turned on after occurrence of a jam, a predetermined time has elapsed after the displacement difference amount was detected and stored, the main tank was replaced, or current environmental humidity is deviated more than a predetermined value previously set for the environmental humidity when the displacement difference amount was detected and stored.

These and other objects, features, and advantages of the present invention will become more readily apparent upon consideration of the following description of the preferred embodiments of the present invention when taken in conjunction with the accompanying drawings.

DETAILED DESCRIPTION OF THE INVENTION

Figure 1:
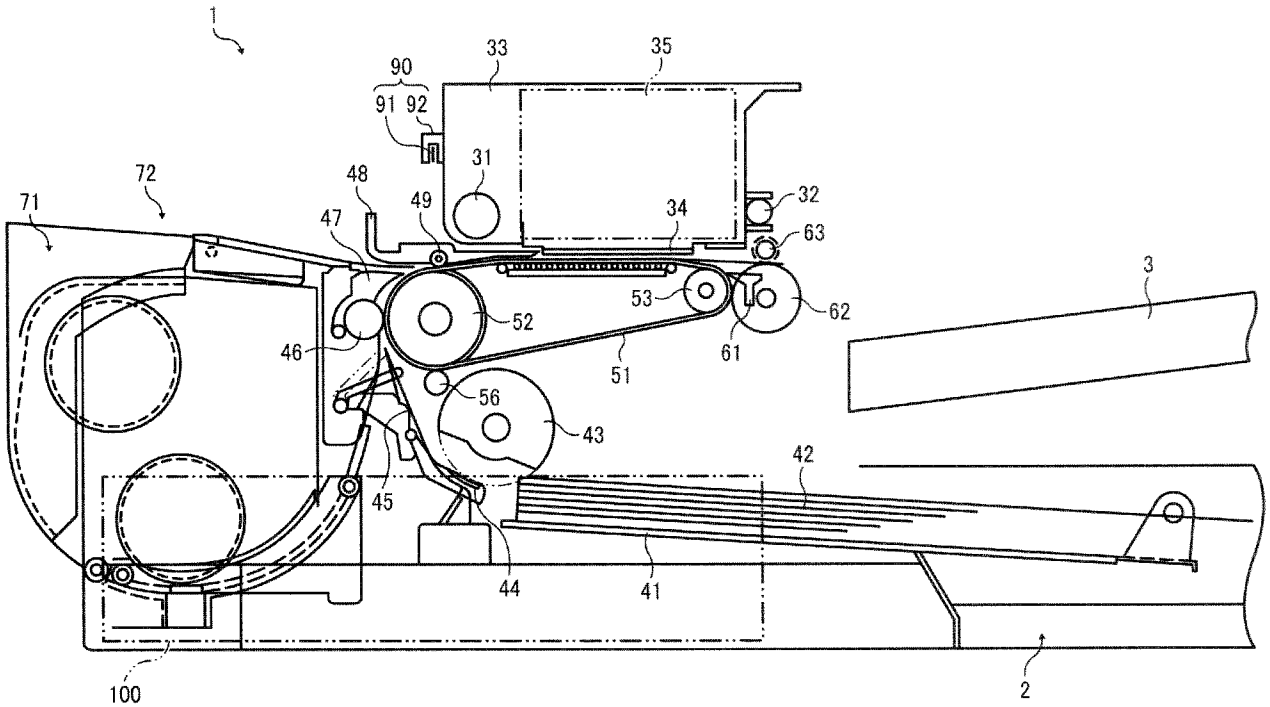
FIG. 1 is a side view of an image forming apparatus illustrating an overall configuration thereof according to a first embodiment of the present invention.
Figure 2:
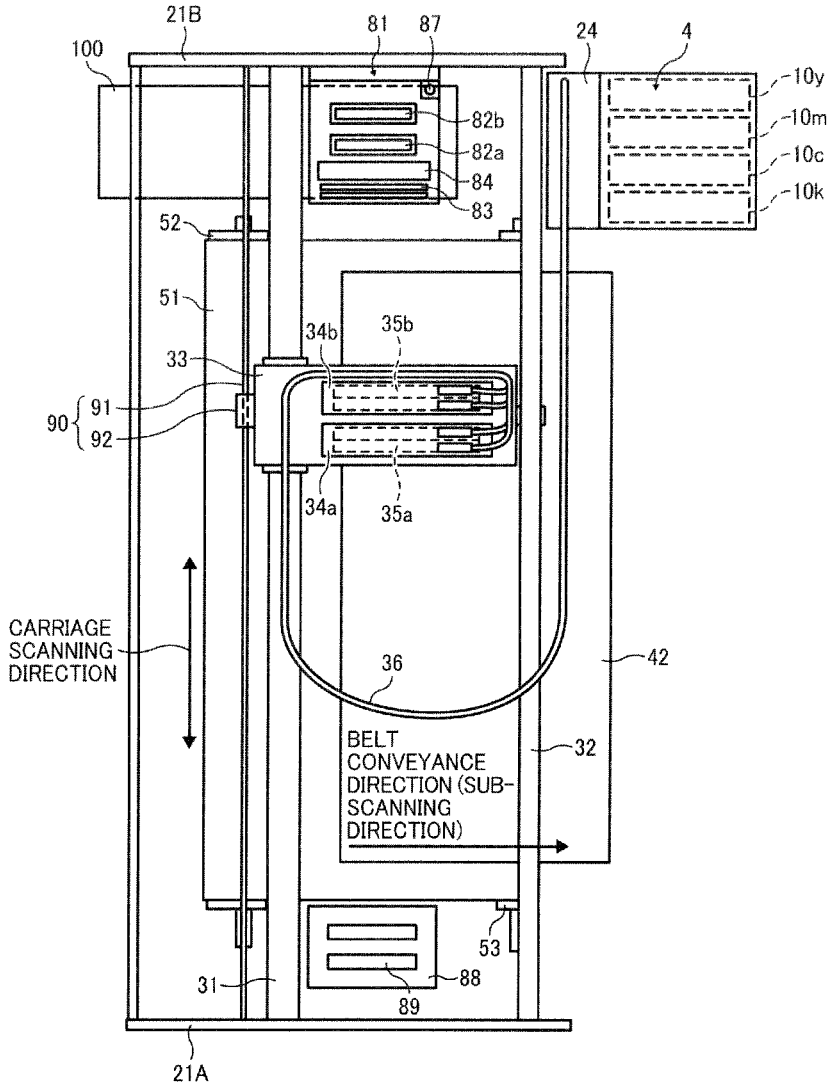
FIG. 2 is an explanatory plan view of a main part of the image forming apparatus in FIG. 1.

Hereinafter, preferred embodiments of the present invention will now be described with reference to accompanying drawings. First, an example of an image forming apparatus according to the present invention will be described with reference to FIGS. 1 and 2. FIG. 1 is a side view of the image forming apparatus illustrating an entire structure thereof and FIG. 2 is a plan view of a main part of the image forming apparatus of FIG. 1 illustrating a general configuration thereof.

This image forming apparatus is a serial-type inkjet recording apparatus, including a main body 1, side plates 21A and 21B disposed at lateral sides of the body 1, main and sub guide rods 31 and 32 horizontally mounted on the lateral side plates 21A and 21B, and a carriage 33 held by guide rods 31 and 32 and slidably movable in a main scanning direction by a main scanning motor (to be described later) via a timing belt.

Print heads 34, mounted on the carriage 33, include divided print heads 34*a*, 34*b*, which will be referred to as the print heads 34 collectively. The print heads 34 are formed of liquid discharging heads to discharge ink droplets of respective colors of yellow (Y), cyan (C), magenta (M), and black (K), and include nozzle arrays formed of a plurality of nozzles arranged in a sub-scanning direction perpendicular to the main scanning direction, with the ink droplet discharging direction oriented downward.

The print heads 34 each include two nozzle arrays. One of the nozzle arrays of the print head 34*a* discharges droplets of black (K) and the other discharges droplets of cyan (C). One of the nozzle arrays of the print head 34*b* discharges droplets of magenta (M) and the other discharges droplets of yellow (Y), respectively.

The carriage 33 includes head tanks 35*a*, 35*b* (to be collectively referred to as head tanks 35), which supply ink of respective colors corresponding to each of the nozzle arrays of the print heads 34. The head tanks 35 are used to supply ink of respective colors by a supply pump unit 24 via a supply tube 36 for each color from ink cartridges 10*y*, 10*m*, 10*c*, and 10*k*, each of which is a main liquid container detachably mounted to a cartridge mount portion 4.

An encoder scale 91 is disposed along the main scanning direction of the carriage 33 and an encoder sensor 92 to read the encoder scale 91 is disposed on the carriage 33. The encoder scale 91 and the encoder sensor 92 form a linear encoder 90. The position of the carriage 33 in the main scanning direction (or the carriage position) and displacement amount thereof can be detected from a detection signal of the linear encoder sensor 90.

There is provided a sheet feeding portion from which sheets 42 piled on a sheet piling portion (pressure plate) 41 of a sheet feed tray 2 are conveyed. The sheet feeding portion includes a sheet feed roller 43 to separate and feed sheets 42 from the sheet piling portion 41 one by one and a separation pad 44 facing the sheet feed roller 43 and formed of a material having a high friction coefficient. The separation pad 44 is pressed against the sheet feed roller 43.

Then, in order to send the sheet 42 fed from the sheet feed portion to the lower side of the print head 34, a guide member 45 to guide the sheet 42, a counter roller 46, a conveyance guide member 47, a pressure member 48 including an end press roller 49, and a conveyance belt 51, a conveying means to electrostatically attract the fed sheet 42 and convey it at a position facing the print heads 34 are disposed.

This conveyance belt 51 is an endless belt stretching over a conveyance roller 52 and a tension roller 53, and is so configured as to rotate in a belt conveyance direction (i.e., a sub-scanning direction). In addition, a charging roller 56, which is a charging means to charge a surface of the conveyance belt 51, is provided. The charging roller 56 is disposed in contact with the surface layer of the conveyance belt 51 and is driven to rotate by the rotation of the conveyance belt 51. The conveyance belt 51 is caused to rotate in a belt conveyance direction by the rotation of the conveyance roller 52 driven by a sub-scanning motor, which will be described later.

Further, as a sheet ejection portion to eject the sheet 42 recorded by the print heads 34, a separation claw 61 to separate a sheet 42 from the conveyance belt 51, a sheet discharge roller 62, and a spur 63 being a sheet discharge roller are provided. A sheet discharge tray 3 is provided underneath the sheet discharge roller 62.

A duplex unit 71 is provided detachably at a backside of the apparatus body 1. This duplex unit 71 pulls in a sheet 42 which has been returned by a reverse rotation of the conveyance belt 51, reverses the sheet 42, and feeds the reversed sheet 42 again in a portion between the counter roller 46 and the conveyance belt 51. An upper surface of the duplex unit 71 is used as a manual tray 72.

A maintenance mechanism 81 including a recovery means to maintain the nozzles of the print heads 34 in good condition is provided at a non-print area at one side in the scanning direction of the carriage 33. The maintenance mechanism 81 includes: cap members 82*a*, 82*b*; a wiper blade 83; a first idle discharge receiver 84; and a carriage lock 87 to lock the carriage 33. The cap members 82*a*, 82*b* are provided to cap the nozzle surfaces of the print heads 34 and are simply referred to as a cap 82 if it is not necessary to distinguish between the cap members. The wiper blade 83 is a blade member to wipe the nozzle surfaces. The first idle discharge receiver 84 receives droplets which are not used for the recording when performing an idle discharge operation in order to discharge agglomerated recording liquid. Further, in the bottom of the maintenance mechanism 81 of the print head, a waste tank 100 to contain waste liquid generated by the maintenance operation is replaceably attached to the apparatus body.

Further, a second idle discharge receiver 88 is disposed at a non-print area at an opposite side in the scanning direction of the carriage 33 in order to receive droplets of recording liquid when performing an idle discharge operation in which recording liquid having an increased viscosity during recording and not contributing to the recording is discharged. The second idle discharge receiver 88 includes openings 89 aligned in the nozzle array direction of the print heads 34.

In the thus-configured image forming apparatus, the sheets 42 are separated and fed one by one from the sheet feed tray 2, the sheet 42 fed upward in a substantially vertical direction is guided by the guide member 45, and is conveyed while being sandwiched between the conveyance belt 51 and the counter roller 46. The leading edge of the sheet 42 is then guided by the conveyance guide member 47 and is pressed against the conveyance belt 51 by the end press roller 49 to change the conveyance direction by 90 degrees.

At that time, an alternate voltage, which is an alternate repetition of positive and negative voltages, is applied to the charge roller 56. Thus, the conveyance belt 51 is charged in an alternate charge pattern, in which a positive charge and a negative charge is alternately applied with predetermined widths in a strip shape in the sub-scanning direction which is the direction of rotation of the conveyance belt 51. When the sheet 42 is fed on the thus alternately charged conveyance belt 51, the sheet 42 is attracted to the conveyance belt 51 and is conveyed in the sub-scanning direction by the rotational movement of the conveyance belt 51.

Then, the print heads 34 are driven in response to image signals while moving the carriage 33 so as to discharge ink droplets onto the stopped sheet 42 to record a single line. After the sheet 42 is conveyed by a predetermined distance, recording of a next line is performed. Upon reception of a recording end signal or a signal indicating that a rear end of the sheet 42 has reached the recording area, the recording operation is terminated and the sheet 42 is discharged to the sheet discharge tray 3.

When the maintenance and recovery of the print heads 34 are performed, the carriage 33 is moved to a home position opposite the maintenance mechanism 81 and capping by the cap member 82 is performed. Then, maintenance and recovery operations such as suction of nozzles and idle discharge, in which liquid droplets not contributive to the image formation are discharged, are performed, thereby forming a quality image by a stable liquid droplet discharge.

Figure 3:
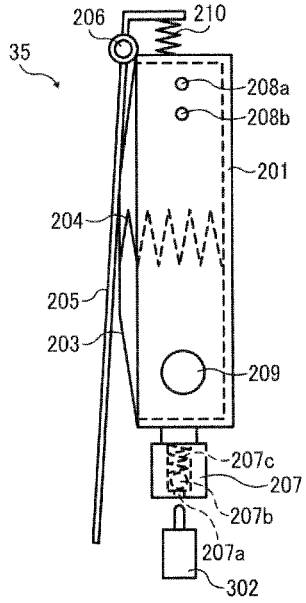
FIG. 3 is a schematic plan view illustrating an example of a head tank.
Figure 4:
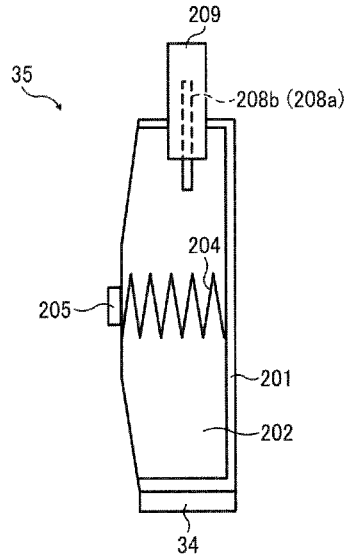
FIG. 4 is a schematic plan view of the head tank in FIG. 3.

Next, an example of the head tank 35 will now be described with reference to FIGS. 3 *and* 4. FIG. 3 is a schematic plan view of the head tank 35 corresponding to one nozzle array and FIG. 4 is a schematic front view of the same.

Each head tank 35 includes a tank case 201 forming an ink container 202 and an opening. The opening of the tank case 201 is sealed with a flexible film member 203. A spring 204 as an elastic member disposed inside the tank case 201 constantly pushes the film member 203 outward. With this structure, because the film 203 of the tank case 201 is pressed outward by the spring 204, if the remaining amount of the ink inside the ink container 202 of the tank case 201 is reduced, a negative pressure is generated.

A displacing member 205 (hereinafter, also referred to as a feeler) disposed outside the tank case 201 and formed of feeler is swingably supported by a support shaft 206 at its one end thereof and is pressed against the tank case 201 by the spring 210. The displacing member 205 is press-contacted against the film member 203 and displaces in conjunction with a movement of the film member 203. Remaining amount of the ink and negative pressure inside the head tank 35 can be obtained by detecting the displacing member 205 by a second sensor 301 disposed on the apparatus body or a first sensor (i.e., a fill-up state sensor) 251 disposed on the carriage 33, both of which will be described later.

A supply port 209 through which the ink is supplied from an ink cartridge 10 is disposed at an upper part of the tank case 201 and the supply port 209 is connected to the supply tube 36. In addition, an air release unit 207 to expose an interior of the head tank 35 to the atmosphere is disposed at a side of the tank case 201. The air release unit 207 includes an air release path 207*a* communicating to an interior of the head tank 35, a valve 207*b* configured to open or close the air release path 207*a*, and a spring 207*c* to press and open the valve 207*b*. When an air release solenoid 302 disposed at the apparatus body presses and opens the valve 207*b*, the air inside the head tank 35 is allowed to be released to the atmosphere, i.e., in a state communicating to the environmental atmosphere.

Electrode pins 208*a* and 208*b* also disposed to detect a height of the liquid ink inside the head tank 35. Because the ink has conductivity, when the ink reaches the electrode pins 208*a* and 208*b*, electric current flows between the electrode pins 208*a* and 208*b* and a resistance value of each electrode pin changes. With this structure, that the height of the liquid ink level inside the head tank 35 has reduced to a predetermined height or below, or that the air amount inside the head tank 35 has increased to a predetermined amount can be detected.

Figure 5:
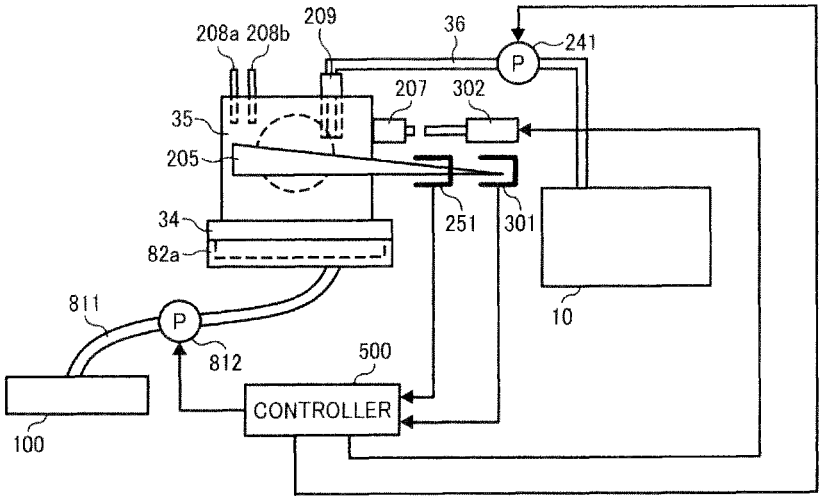
FIG. 5 is a schematic explanatory view illustrating ink supply and discharge system.

Next, an ink supply and discharge system in the present image forming apparatus will now be described with reference to FIG. 5.

A supply pump unit 24 includes a fluid conveyance pump 241 serving to convey the liquid ink. First, supplying the ink from the ink cartridge 10 ("main tank", hereinafter) to the head tank 35 is performed via the supply tube 36 by the fluid conveyance pump 241. The fluid conveyance pump 241 is a reversible pump formed of a tube pump and performs both an operation to supply ink from the ink cartridge 10 to the head tank 35 and an operation to return ink from the head tank 35 to the ink cartridge 10.

Further, the maintenance mechanism 81 includes a suction cap 82*a* to cap the nozzle surface of the print head 34 and a suction pump 812 connected to the suction cap 82*a*. When the suction pump 812 is driven in a state that the nozzle surface is capped with the cap 82*a*, the ink is sucked from the nozzle via the suction tube 811 and the ink inside the head tank 35 can be sucked. The sucked waste ink is discharged to the waste tank 100.

In addition, an air release solenoid 302, a pressing member disposed on the apparatus body, serves to open or close the air release unit 207 of the head tank 35. By operating the air release solenoid 302, the air release unit 207 can be released to the atmosphere.

The first sensor 251, an optical sensor configured to detect the displacing member 205 is disposed on the carriage 33, and the second sensor 301, an optical sensor configured to detect the displacing member 205 is disposed on the apparatus body. The ink supplying operation to the head tank 35 is controlled by using detection results of these first and second sensors 251 and 301.

The driving of the fluid conveyance pump 241, air release solenoid 302, and suction pump 812 and the ink supplying operation according to the present invention are controlled by a controller 500.

Figure 6:
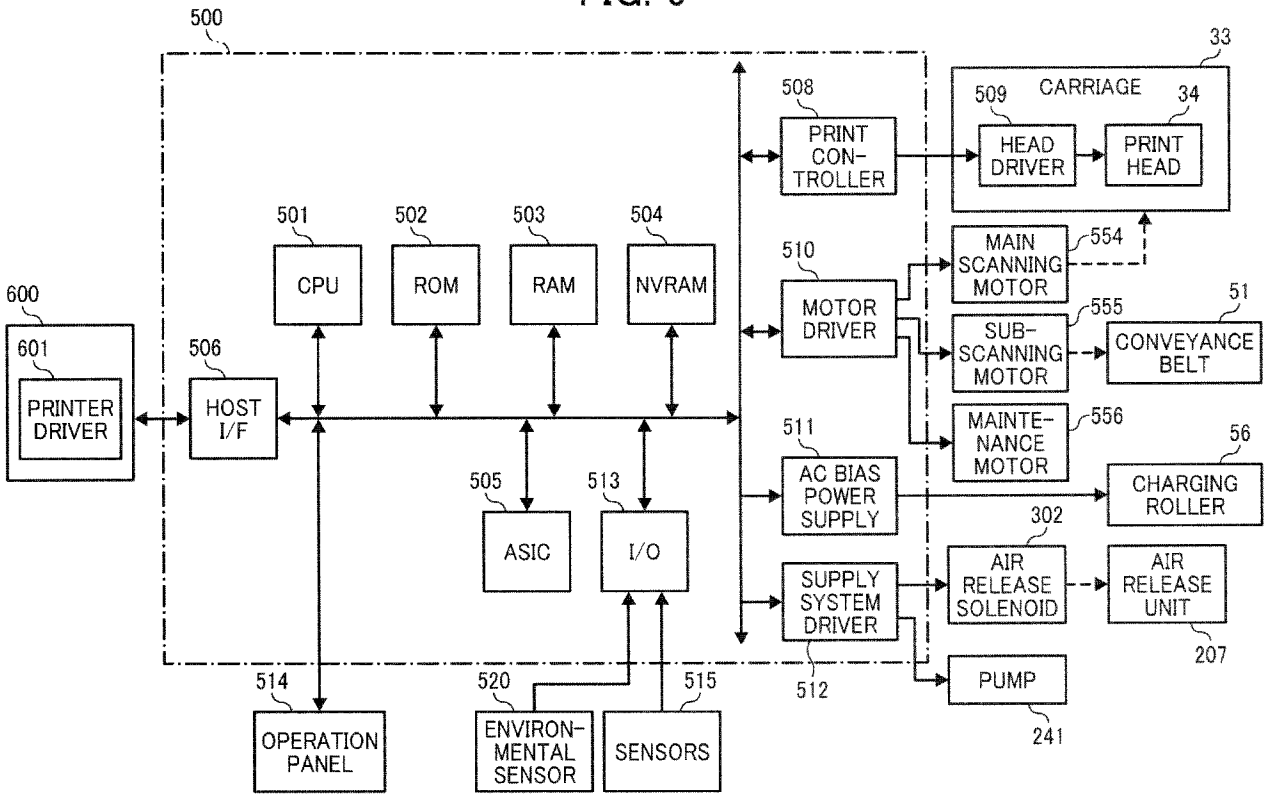
FIG. 6 is a block diagram illustrating a general outline of a controller.

Next, an outline of the controller in the image forming apparatus will now be described with reference to FIG. 6. FIG. 6 is an overall block diagram of the controller 500.

The controller 500 serves to control the apparatus entirely and includes a CPU 501; various programs performed by the CPU 501; a read-only memory (ROM) 502 storing various fixed data; a random access memory (RAM) 503 temporarily storing image data; a rewritable nonvolatile memory 504 as a memory means in the present invention capable of holding data while the power to the apparatus is being shut down; and an ASIC 505 configured to handle various signals to the image data, image processing to perform rearrangement and the like, and input/output signals to control an entire apparatus.

The controller 500 further includes a data transmitter to drive and control the print head 34; a print controller 508 including a drive signal generator; a head driver or driver IC 509, disposed on the carriage 33, to drive the print head 34; a main scanning motor 554 to move the carriage 33 to scan; a sub-scanning motor 555 to move to circulate the conveyance belt 51; a motor driver 510 to drive a maintenance motor 556 of the maintenance mechanism 81; an AC bias power supply 511 to supply an AC bias to the charging roller 56; the air release solenoid 302, disposed on the apparatus body, to open/close the air release unit 207 of the head tank 35; and a supply system driver 512 to drive the fluid conveyance pump 241, and the like.

In addition, an operation panel 514 for inputting necessary information to the apparatus and displaying the information thereon is connected to the controller 500.

The controller 500 further includes an I/F 506 through which data and signals are transmitted between a host and the apparatus. The I/F 506 receives data and signals via a cable or a network from the host 600 including an information processor such as a PC, an image reader such as an image scanner, a picture capturing device such as a digital camera, and the like.

The CPU 501 of the controller 500 reads and analyzes print data in a reception buffer included in the I/F 506, causes the ASIC 505 to perform necessary image processing and data rearrangement processing, and transfers the processed image data from the print controller 508 to the head driver 509. There is provided a printer driver 601 at a side of the host 600. The printer driver 601 generates dot pattern data for outputting an image.

The print controller 508 transmits the above image data as serial data as well as outputs transfer clock signals, latch signals and control signals necessary to transfer the image data and ensure that the image transfer has been performed, to the head driver 509. The print controller 508 further includes a drive signal generator formed of a D/A converter to perform digital-to-analog conversion of pattern data of driving pulses stored in the ROM, voltage and current amplifiers, and the like, and outputs drive signals formed of a drive pulse or a plurality of drive pulses to the head driver 509.

The drive pulse is a drive signal given from the print controller 508 based on the image data corresponding to one line of data serially input to the print head 34 which includes a print head 7. The head driver 509 selectively applies the drive pulse to a drive element (for example, a piezoelectric element) that generates energy to have the print head 7 to discharge the ink droplets, thereby driving the print head 7. In this operation, by selecting a drive pulse to formulate a drive signal, dots with various sizes such as a large dot, a medium dot, and a small dot can be selectively shot.

An environmental sensor 520 as an environmental condition detector detects temperature and humidity in which the apparatus is installed. An I/O 513 obtains information from the environmental sensor 520 and various other sensors 515 attached to the apparatus, and extracts necessary information to control an entire printer including the print controller 508, the motor driver 510, the AC bias power supply 511, and ink supply control to the head tank 35.

The other sensors 515 includes the first sensor 251 and the second sensor 301, the electrode pins 208*a* and 208*b*, an optical sensor to detect a position of the sheet, and interlock switch to detect open/close of the cover. The I/O 513 performs controlling various sensors information.

Next, negative pressure forming operation in the head tank 35 in the thus-configured image forming apparatus will now be described referring to FIGS. 7A and 7B.

Figure 7A:
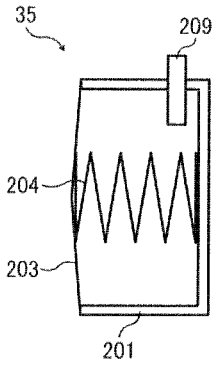
FIGS. 7A and 7B are views for explaining negative pressure generating operation of a head tank.
Figure 7B:
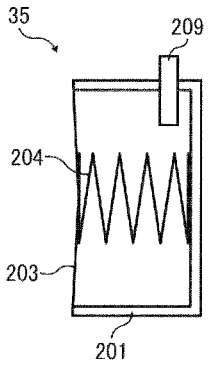

As illustrated in FIG. 7A, after the ink is supplied from the main tank 10 to the head tank 35, the ink is sucked from the head tank 35 as described above or by driving the print head 34, and an idle discharge (i.e., discharge of ink droplets not contributive to image formation) is performed. Then, by reducing the ink amount inside the head tank 35, the film 203 tends to displace toward an inner side against the pressing force of the spring 204 and negative pressure is generated by the pressing force of the spring 204.

Further, when the fluid conveyance pump 241 sucks in from the head tank 35, the film 203 is further pulled inwardly to the head tank 35 and the spring 204 is further compressed, thereby increasing the negative pressure inside the head tank 35.

When the ink is supplied into the head tank 35 from this state, because the film 203 is pushed outward of the head tank 35, the spring 204 extends and the negative pressure decreases.

By the repeated operation as above, the negative pressure inside the head tank 35 can be maintained constant.

Figure 8:
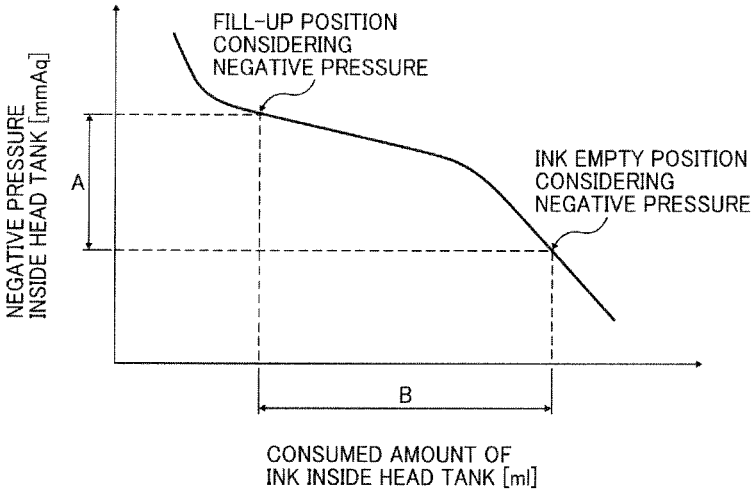
FIG. 8 is a view for explaining a relation between a negative pressure and an amount of ink in the head tank.

Here, a relation between the negative pressure inside the head tank 35 and the ink amount inside the head tank 35 will now be described referring to FIG. 8.

The negative pressure inside the head tank 35 has a proportional relation with the ink amount inside the head tank 35. When the ink amount inside the head tank 35 is large, the negative pressure inside the head tank 35 is small. When the ink amount is small, the negative pressure inside the head tank 35 increases. When the negative pressure inside the head tank 35 is too small, the ink leaks from the print head 34. When the negative pressure is too high, air and dust tends to mix in from the print head 34, to cause defective discharge to occur.

Then, the ink supply to the head tank 35 is controlled within an ink amount B inside the head tank 35 so that the negative pressure inside the head tank 35 falls within a predetermined negative pressure control range A. Herein, the ink amount of the head tank 35 corresponding to a lower limit (in which the negative pressure is low and the ink amount is high) is represented as a "fill-up position", and the ink amount corresponding to an upper limit (in which the negative pressure is high and the ink amount is low) of the negative pressure control range A is represented as an "ink empty position" as the displacement position of the displacing member 205.

Next, how to set the ink amount inside the head tank 35 to the fill-up position will now be described referring to FIGS. 9A to 9C. In the following figures, the head tank 35 is schematically shown differently from FIGS. 3 and 4.

Figure 9A:
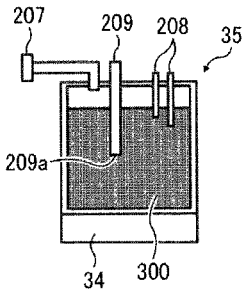
FIGS. 9A-9C are views for explaining a method to set the ink amount in the head tank to be filled up.
Figure 9B:
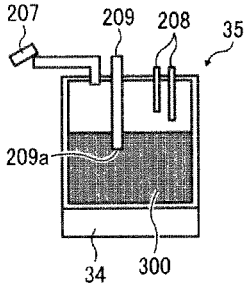

From a state as illustrated in FIG. 9A, by releasing the negative pressure inside the head tank 35 by opening the air release unit 207, a liquid level in the head tank 35 lowers as illustrated in FIG. 9B. It is preferred that a supply opening 209*a* of the supply port 209 is below the liquid level. This is because when the supply opening 209*a* is above the liquid level, air mixes in the supply tube 36 via the supply opening 209*a* or the supply port 209. When the ink is supplied subsequently, air bubbles may be discharged with ink from the supply opening 209*a*. When the supply of ink continues in this state, the air bubbles attach to the interior of the air release unit 207, thereby causing agglomeration of the valve and leak of the liquid.

Figure 9C:
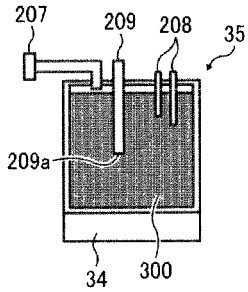

After the negative pressure in the head tank 35 is released and the liquid level lowers, the ink 300 is supplied as illustrated in FIG. 9C. When the ink 300 is supplied, the liquid level is elevated, and the ink 300 continues to be supplied until the electrode pins 208*a* and 208*b* detect the liquid level of a predetermined height. Then, when the air release unit 207 is closed and a predetermined amount of ink is sucked and discharged, the pressure inside the head tank 35 becomes a predetermined value and the ink amount of the head tank 35 can be the fill-up position that can obtain a predetermined value of negative pressure (i.e., the fill-up position considering the negative pressure).

Next, how to detect a displacement amount of the displacing member 205 of the head tank 35 will now be described with reference to FIGS. 10A-10B and FIGS. 11A-11C.

Figure 10A:
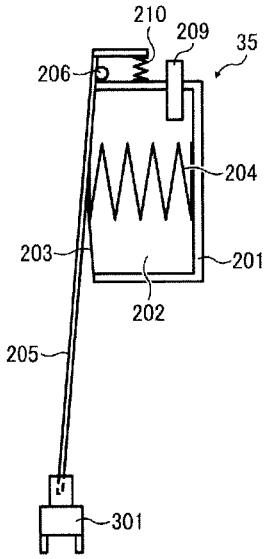
FIGS. 10A and 10B are views for explaining a method to set the ink amount in the head tank to be filled up by using a second sensor alone.
Figure 10B:
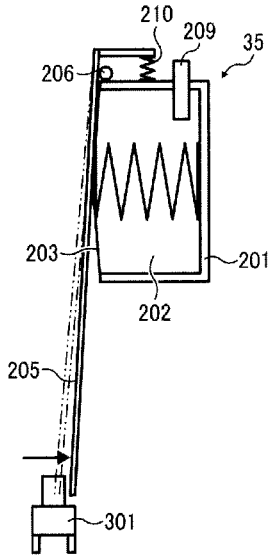

First, referring to FIG. 10, a case in which the displacement amount is detected using the second sensor or the fill-up sensor 301 alone disposed at the apparatus body alone. As illustrated in FIG. 10A, the position of the carriage 33 obtained by the linear encoder 90 when the second sensor 301 detects the displacing member 205 of the head tank 35 is stored in the memory. As illustrated in FIG. 10B, when the displacing member 205 displaces from a position indicated by a solid line to a position indicated by a broken line, the carriage 33 is displaced until the second sensor 301 detects the displacing member 205. A difference amount between the detected position of the carriage 33 by the second sensor 301 and the stored position of the carriage 33 (that is, a carriage moving amount) is obtained as a displacement amount.

Here, when the ink amount of the head tank 35 is set to the aforementioned fill-up position, for example, after the air release unit 207 is brought into an open state and the air inside the head tank 35 has an atmospheric pressure, the ink is supplied until the electrode pins 208 detect the liquid level and the air release unit 207 is closed. In this case, by scanning the carriage 33, the second sensor 301 is made to detect the displacing member 205 and the carriage position when the second sensor 301 detects the displacing member 205 is stored as the air release position.

Then, by sucking and discharging a predetermined amount of ink from the print head 34 to generate negative pressure inside the head tank 35, the position of the displacing member 25 is set to the fill-up position. Because a predetermined amount of ink is sucked from the air release position, the displacing member 205 in the fill-up position is positioned at an inner position than the air release position.

However, in the present method, the displacement amount of the displacing member 205 from the air release position to the fill-up position may include a large variation due to variations in the sucked amount when the predetermined amount of ink is sucked from the air release position and variations in the relation between the sucked amount and the displacement amount of the displacing member 205.

Accordingly, in the present embodiment, the fill-up position considering the negative pressure is set by displacing the displacing member 205 by a predetermined displacement amount from the air release position, and variations of the displacement amount of the displacing member 205 from the air release position to the fill-up position are eliminated. Thus, the resolution is improved to the control operation using a displacement amount of the displacing member 205.

With the structure of the second sensor alone, when the operation to fill in the ink to the head tank 35 until the fill-up position is performed, because the displacement amount of the displacing member 205 of the head tank 35 needs to be detected, the carriage 33 needs to be displaced in accordance with the detectable position of the displacing member 205 by the second sensor 301.

Then, in addition to the second sensor 301 disposed at the apparatus side, the first sensor 251 to detect the displacing member 205 of the head tank 35 is disposed at the carriage 33 according to the present invention.

Specifically, the position at which the second sensor 301 disposed at the apparatus body 1 detects the displacing member 205 is set to the second position, which is set as the fill-up position. In addition, the position at which the first sensor 251 disposed at the carriage 33 detects the displacing member 205 is set to the first position, which is set as the position in which amount of ink remaining inside the head tank 35 is less than the second position.

In other words, the first sensor 251 to detect that the displacing member 205 comes to a predetermined first position is disposed to the carriage 33, and the second sensor 301 to detect that the displacing member 205 comes to a predetermined second position (i.e., the fill-up position) is disposed at the apparatus body 1 when the carriage 33 is stopped at a predetermined detection position (i.e., the fill-up position) and the liquid ink is filled from the main tank 10 to the head tank 35. The first position is the position in which the amount of ink remaining inside the head tank 35 is less than the second position.

Next, how to detect the displacement difference amount between a position detected by the first sensor 251 of the displacing member 205 and a position detected by the second sensor 301 will now be described with reference to FIG. 11.

Figure 11C:
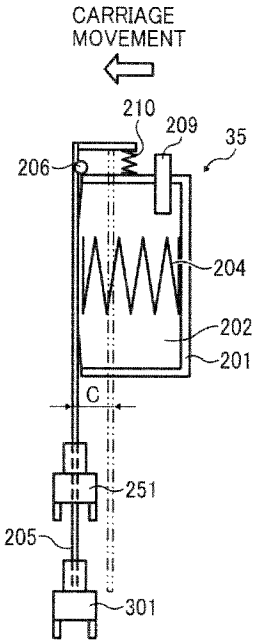
FIGS. 11A-11C are views for explaining a method to set the ink amount in the head tank to be filled up by using a first and second sensors alone.
Figure 11B:
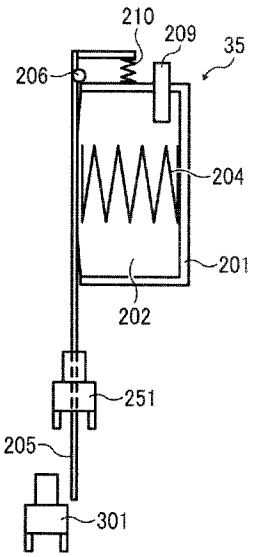
Figure 11A:
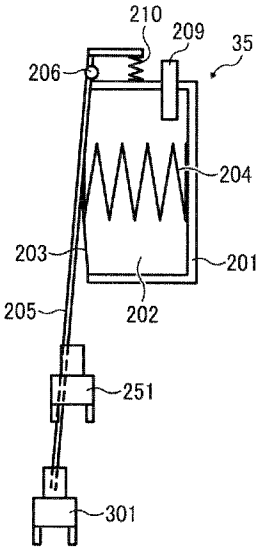

As illustrated in FIG. 11A, the carriage 33 is moved to a position in which the second sensor 301 can detect the displacing member 205. As illustrated in FIG. 11(*b*), from a state in which the displacing member 205 is at the air release position or the fill-up position, the ink is sucked by a reverse operation of the fluid conveyance pump 241 until the first sensor 251 detects the displacing member 205 and the reverse operation of the fluid conveyance pump 241 is stopped. Then, as illustrated in FIG. 11C, in a state in which the first sensor 251 detects the displacing member 205, the carriage 33 is moved until the second sensor 301 detects the displacing member 205. By measuring the distance that the carriage is moved by the linear encoder 90, the displacement difference amount C of the film 203 or the displacing member 205 from the air release position or the fill-up detection position until the first sensor 251 detects the displacing member 205 is detected. Thus, the displacement difference amount C is measured. The detected displacement difference amount C is stored and held in a non-volatile memory such as an NVRAM 504.

Thus, by obtaining the displacement difference amount C and storing it, when it is detected that a predetermined amount of ink has been discharged during the scanning of the carriage 33, that is, when the consumed amount of ink exceeds a predetermined amount, the ink is supplied from the main tank 10 to the head tank 35. After the first sensor 251 detects the displacing member 205 of the head tank 35, the ink corresponding to the displacement difference amount C is further supplied, thereby supplying the ink inside the head tank 35 until the fill-up position.

In this case, because the first sensor 251 detects a position, detection error of the ink discharge amount or detection error of the conveyance amount by the fluid conveyance pump 241 and resulted accumulation of the detection error is eliminated when the first sensor 251 detects the position, and is not augmented. Accordingly, even when the carriage 33 is scanning, ink discharge and ink supply can be repeatedly performed.

By repeating this series of operations, without terminating printing on the way, the ink can be supplied to the head tank 35 up to a fill-up position constantly, and the print speed and the print performance may be improved.

Figure 12:
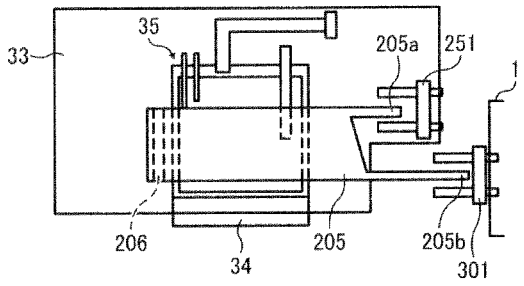
FIG. 12 is a view illustrating exemplary positions of the first and second sensors.
Figure 13:
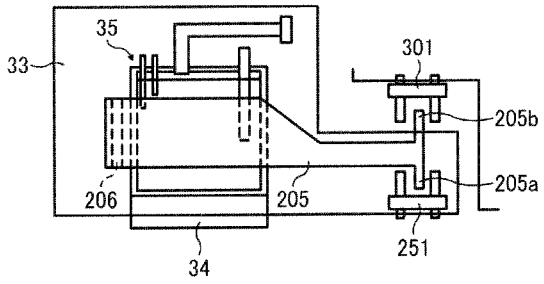
FIG. 13 is a view illustrating other exemplary positions of the first and second sensors.

FIGS. 12 and 13 are views illustrating the first and second sensors which are disposed different positions.

In an example as illustrated in FIG. 12, the displacing member 205 of the head tank 35 includes detecting portions 205*a* and 205*b* having a different length from the support shaft 206 (i.e., a pivotal shaft). The first sensor 251 of the carriage 33 detects the detecting portion 205*a* and the second sensor 301 of the apparatus side detects the detecting portion 205*b*.

In an example as illustrated in FIG. 13, the displacing member 205 of the head tank 35 includes detecting portions 205*a* and 205*b* having a same length from the support shaft 206 (i.e., a pivotal shaft). The first sensor 251 of the carriage 33 detects the detecting portion 205*a* and the second sensor 301 of the apparatus side detects the detecting portion 205*b*.

Figure 14:
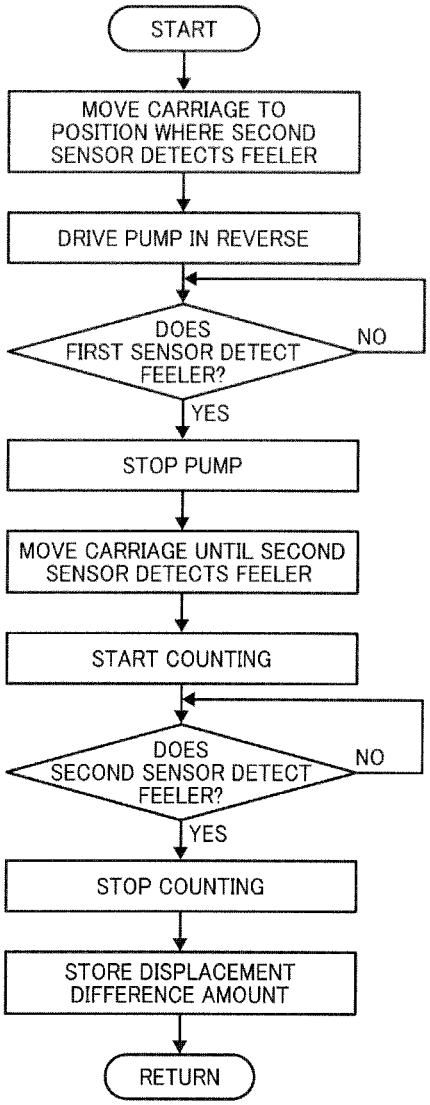
FIG. 14 is a flow chart illustrating a detection process performed by a controller to detect a displacement difference amount.
Figure 15:
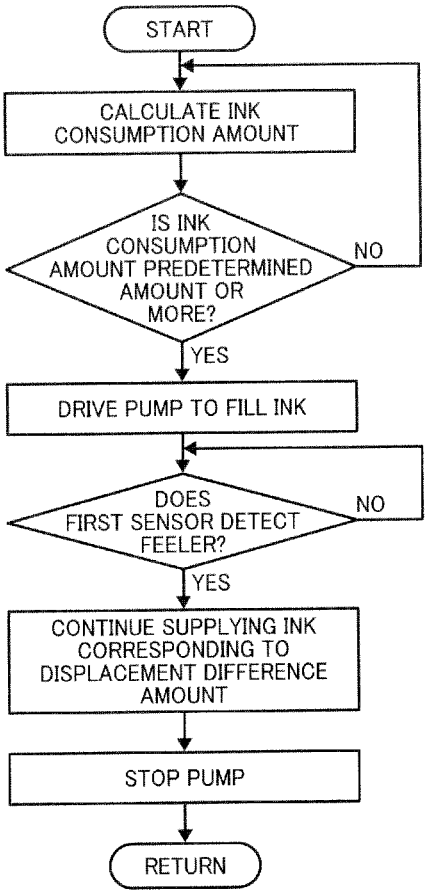
FIG. 15 is a flow chart illustrating an ink-filling process during printing.

FIGS. 14 and 15 are flowcharts each illustrating the operations performed by the controller.

First, in the displacement difference amount detection process as illustrated in FIG. 14, the second sensor 301 moves the carriage 33 to a position to detect the displacing member 205, which is represented as a "feeler" in figures. Then, from a state in which the displacing member 205 is at an air release position or a fill-up position, the fluid conveyance pump 241 sucks in ink by reverse operation thereof until the first sensor 251 detects the displacing member 205 and stops reverse operation.

Subsequently, the second sensor 301 moves the carriage 33 up to a position in which the second sensor 301 detects the displacing member 205, counting by an encoder 90 starts, counting by the encoder 90 stops when the second sensor 301 detects the displacing member 205, and the counting value is stored in the memory as the displacement difference amount C.

Next, with reference to FIG. 15, an amount of ink consumed in the head tank 35 is calculated in the filling process during printing. Calculation of the amount of ink consumed can be obtained by a calculation by counting the number of droplets discharged for image formation or the number of droplets discharged in the idle discharge operation during printing and by multiplying the obtained count number by an amount of droplet. (This method is called "soft count.") In addition, when the cleaning operation to suck in the ink from print head 34 is performed, because the consumption amount by the sucking in is previously determined, the sucked-in amount may be added.

Then, from the ink amount and the amount of ink consumed at the fill-up position, it is determined whether the calculated amount of ink remaining becomes a predetermined value. When the amount of ink remaining equals to the predetermined value, the fluid conveyance pump 241 is driven to rotate normally and the ink is filled from the main tank 10 to the head tank 35. In this case, it is determined whether the first sensor 251 detects the displacing member 205 of the head tank 35, and when the first sensor 251 detects the displacing member 205 of the head tank 35, the ink corresponding to the displacement difference amount C is further filled in the head tank 35. With this configuration, the ink is filled in the head tank 35 up to the fill-up position.

Thereafter, the fluid conveyance pump 241 is stopped and the calculated amount of the amount of ink consumed is reset.

Thus, even in the printing operation, without returning the carriage 33 to its home position, the head tank 35 is filled with ink up to the fill-up position.

As described above, the head tank 35 includes a displacing member 205 configured to displace corresponding to the liquid remaining amount. The carriage 33 includes a first sensor 251 configured to detect that the displacing member 35 comes to a predetermined first position, and the apparatus body includes a second sensor 301 configured to detect that the displacing member 205 comes to a predetermined second position. The first position represents that the liquid remaining amount inside the head tank 35 is less than the second position does. The displacement difference amount corresponding to the displacement amount of the displacing member 205 between the position detected by the first sensor 251 and that detected by the second sensor 301 is obtained and stored. When the liquid is supplied from the main tank 10 to the head tank 35 without using the second sensor 301, the apparatus according to the present embodiment is configured to supply liquid corresponding to the displacement difference amount after the first sensor 251 detects the displacing member 205. Therefore, even when the carriage 33 is being moved, an appropriate amount of liquid can be supplied from the main tank 10 to the head tank 35, thereby improving printing speed.

Herein, why the second sensor 301 is disposed at the apparatus body in addition to the first sensor 251 at the carriage 33 will now be described.

First, because the position in which the head tank 35 becomes full changes due to environmental conditions, the first sensor 251 disposed at the carriage 33 detects only one position and the environmental difference cannot be obtained with the first sensor 251 alone. Then, by displacing the second sensor 301 at the apparatus body, the displacement amount can be obtained by moving the carriage 33 to an air release position or fill-up position which changes due to the environmental conditions.

Specifically, by disposing a detecting point fixed on the carriage 33 and another detecting point movable by moving the carriage 33, a distance between two points can be detected based on pump driving time, driving rotation number, or an encoder count by the move of the carriage 33.

By contrast, mounting a sensor and an encoder which can observe every displacement on the carriage 33 alone may increase the cost of the detectors and enlarge the size of the carriage 33, thereby increasing the size of the apparatus.

In addition, the liquid supply and suction amount of the fluid conveyance pump 241 varies depending on the environmental conditions, aging over years, and deviations from pump to pump. Accordingly, the supply amount of the pump needs to be confirmed at the positional detection by the second sensor 301 of the apparatus body subject to the environmental conditions. If the second sensor 301 is not disposed at the apparatus body and the liquid supply and suction is controlled based on the driving amount of the fluid conveyance pump alone, defects due to an excessive supply or shortage may occur. Accordingly, the second sensor 301 is disposed at the apparatus body to ensure safety in the control.

Figure 16:
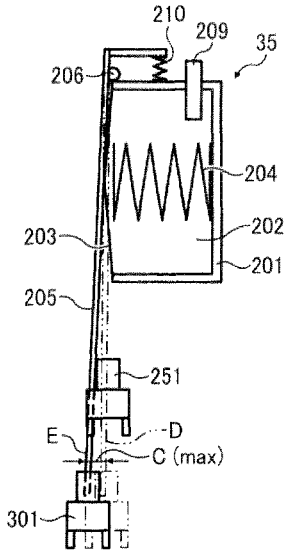
FIG. 16 is a cross-sectional plan view of the head tank for explaining a relation between humidity and a displacement amount of a displacing member.
Figure 17:
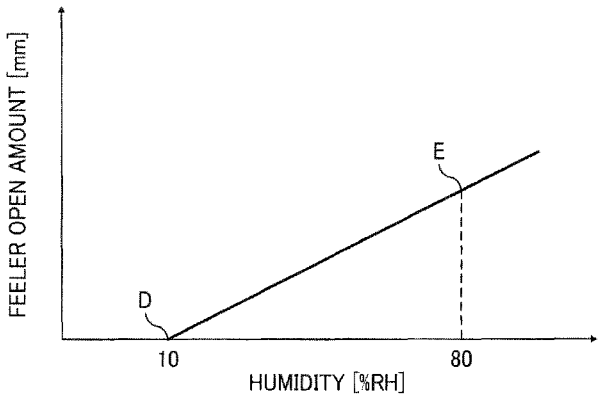
FIG. 17 is an explanatory view illustrating a relation between humidity and a displacement amount of a displacing member.

Next, a relation between humidity and a displacement amount of the displacing member will be described with reference to FIGS. 16 to 18. FIG. 16 is a cross-sectional plan view of the head tank for explaining a relation between humidity and a displacement amount of a displacing member; FIG. 17 shows one example representing a relation between humidity and a displacement amount of a displacing member; and FIG. 18 is a view illustrating a relation between humidity and a displacement amount of a displacing member.

The film 203 of the head tank 35 displaces according to environmental condition of the image forming apparatus. The film 203 extends or shrinks due to an environmental change such as a change in the humidity. When the position of the displacing member 205 being the fill-up position in the low humidity of 10% at room humidity is set to D and the humidity is increased to high humidity of 80% at room humidity, the film 203 extends and similarly the displacing member 205 displaces to a position E as illustrated in FIG. 16.

Figure 18:
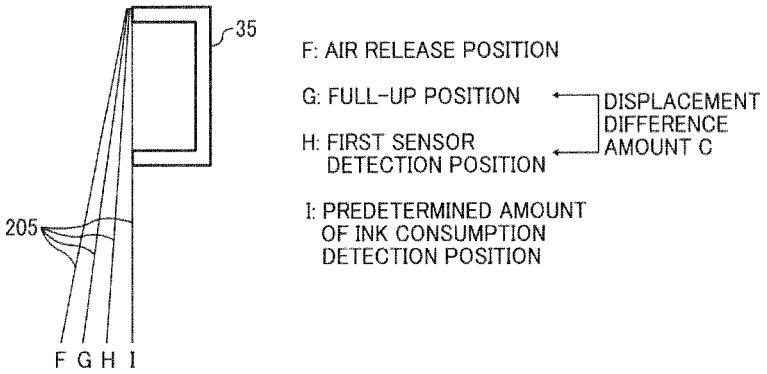
FIG. 18 is an explanatory view illustrating a relation between humidity and a displacement amount of a displacing member.

Specifically, by the change in the surrounding environment, the air release position F and the fill-up position G of the displacing member 205 changes as illustrated in FIG. 18.

Then, the first sensor 251 is disposed at a predetermined detection position in which the film 203 maximally shrinks under the predetermined environment. For example, the first sensor 251 can detect the displacing member 205 at the fill-up position D even under the lowest humidity environment.

With this structure, when setting at the fill-up position D under the lowest humidity environment, when the displacing member 205 that displaces with the supply of ink displaces to the fill-up position D, the first sensor 251 detects the displacing member 205 as well as the second sensor 301 detects the displacing member 205 and the displacement difference amount C equals to zero. In addition, when setting to the fill-up position E under the high humidity environment, the first sensor 251 first detects the displacing member 205, and then, the second sensor 301 detects the displacing member 205.

In this case, by storing the displacement difference amount C (max) from the detection by the first sensor 251 to the detection by the second sensor 301, ink corresponding to the displacement difference amount C is supplied from a detection position H (see FIG. 18) of the first sensor 251 even during the printing operation, the fill-up position suitable for each environment can be set.

Next, with reference to FIG. 19, correction of the displacement difference amount or re-detection of the displacement difference amount and storing it in response to the environmental change will now be described.

As described above, when the environmental condition changes after detecting the displacement difference amount C, the displacement difference amount C needs to be detected and stored again. When the displacement difference amount C is re-detected and stored in a case in which the environmental condition changed due to for example printing, the printing operation is to be terminated temporarily and problems occur such as degradation of the printing performance and lowered image quality.

Then, an environmental sensor 520 to detect the environmental conditions under which the apparatus is located is provided so as to cope with the environmental conditions change without terminating the printing operation.

Figure 19:
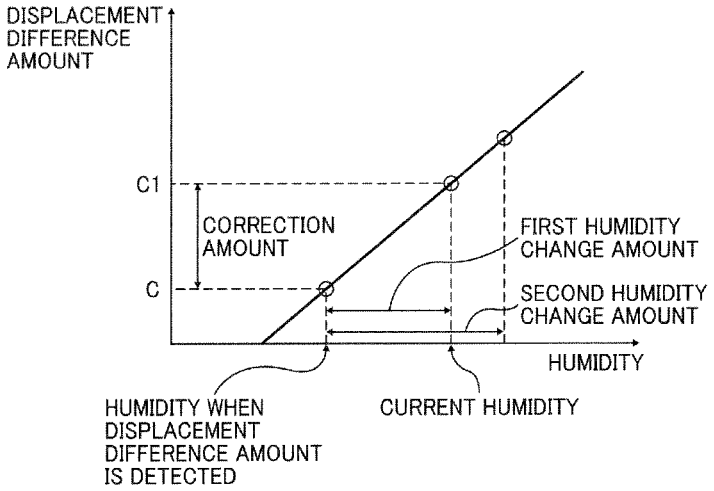
FIG. 19 is a view illustrating correction and re-detection of displacement difference amount corresponding to environmental condition change and memorizing operation in the first embodiment of the present invention.

Specifically, as illustrated in FIG. 19, the environmental humidity when the displacement difference amount C was detected is detected and stored, and then, when the difference between the current environmental humidity now detected and the stored humidity is more than a first humidity change being a predetermined first environmental change and less than a second humidity change being a predetermined second environmental change, the stored displacement difference amount C is corrected by a predetermined correction coefficient corresponding to the humidity change. Then, the corrected displacement difference amount C is stored as a corrected displacement difference amount C1. The corrected displacement difference amount C1 can be obtained by a formula: C1=displacement difference amount C+humidity change×correction coefficient. The correction coefficient is a predetermined value. The ink supply control thereafter is based on the corrected displacement difference amount C1.

As aforementioned, the fill-up position is set by displacing the displacing member 205 from the air release position to a predetermined displacement amount considering the negative pressure, and by eliminating variations of the displacement amount of the displacing member 205 from the air release position to the fill-up position. Thus, a high-resolution control can be performed with a displacement amount of the displacing member 205. Further, because correction of the displacement difference amount C in response to the environmental change is the correction to the displacement amount of the displacing member 205, variations in the correction can be minimized.

When the humidity change exceeds the second humidity change which is greater than the first humidity change, the displacement difference amount C is again detected and stored.

This is because due to the humidity change more than a predetermined value, the variations in the correction become large, the discrepancy from the appropriate displacement difference amount C becomes large, and the negative pressure inside the head tank 35 at the fill-up position is not appropriate, thereby causing ink leakage and breakage of the head tank 35. Thus, by detecting the displacement difference amount C again without performing correction, a proper ink supply control is enabled matched with environment at that time.

Instead of the environmental humidity, a similar correction and control can be performed by detecting the environmental temperature.

The apparatus according to the present embodiment includes an environmental condition sensor to detect environmental condition under which the apparatus is located, and is controlled such that the environmental condition under which the displacement difference amount is detected is stored, and when the change of the current environmental change with respect to the stored environmental condition is greater than the predetermined first environmental change and less than the predetermined second environmental change, the stored displacement difference amount is corrected. When the change of the current environmental condition relative to the stored environmental condition exceeds the second environmental change, the displacement difference amount is detected and stored. Thus, without degrading the printing performance relative to the environmental condition change, liquid ink supply can be performed with high resolution.

Next, with reference to FIG. 20, correction of the displacement difference amount in response to the change in the environmental condition will now be described according to a second embodiment of the present invention.

Figure 20:
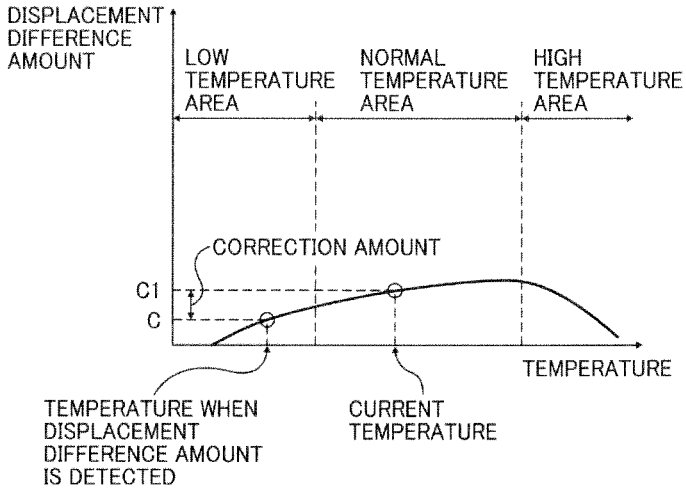
FIG. 20 is a view illustrating correction and re-detection of displacement difference amount corresponding to environmental condition change and memorizing operation in a second embodiment of the present invention.

As illustrated in FIG. 20, the environmental temperature when the displacement difference amount C was detected is detected and stored, and then, when the difference between the current environmental temperature now detected and the stored temperature is more than a first temperature change being a predetermined first environmental change and less than a second temperature change being a predetermined second environmental change, the stored displacement difference amount C is corrected by a predetermined correction coefficient corresponding to the temperature change. Then, the corrected displacement difference amount C is stored as a corrected displacement difference amount C1. The ink supply control thereafter is based on the corrected displacement difference amount C1.

The environmental temperature is for example divided into predetermined temperature areas from low, normal, to high and correction coefficient for each area which is necessary to maintain the negative pressure inside the head tank 35 properly is prepared beforehand. Then, using the correction coefficient of an area which the current environmental temperature belongs to, the displacement difference amount C is corrected.

According to this, the displacement difference amount C can be corrected more properly in response to the environmental condition. The correction corresponding to the environmental humidity can be performed similarly.

Figure 21:
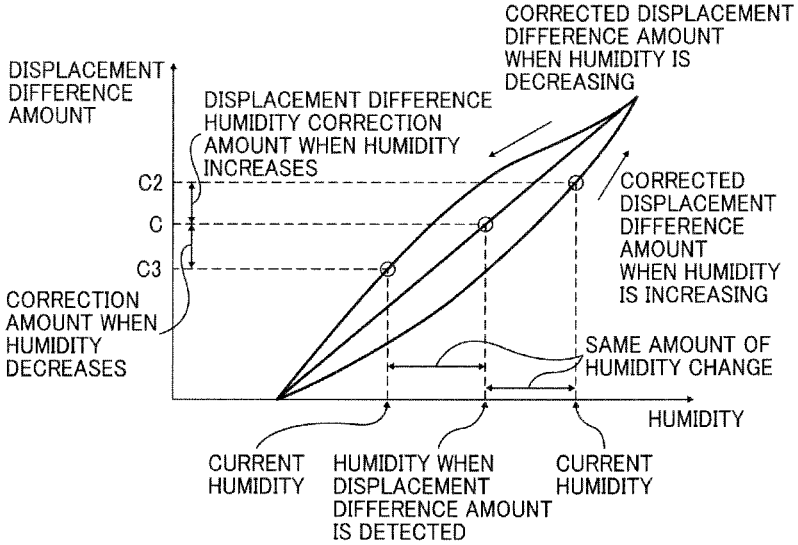
FIG. 21 is a view illustrating correction and re-detection of displacement difference amount corresponding to environmental condition change and memorizing operation in a third embodiment of the present invention.

Next, with reference to FIG. 21, correction of the displacement difference amount in response to the change in the environmental condition will now be described according to a third embodiment of the present invention.

Herein, the correction coefficient to correct and obtain the displacement difference amount C to meet the current environmental humidity is changed between a case in which the current environmental humidity is so changing as to increase than the environmental humidity when the displacement difference amount C was detected and a case in which the current environmental humidity is decreasingly changing.

Specifically, in the environmental humidity change, even with the same environmental humidity change, change of the film 203 and the displacement amount of the displacing member 205 vary between the humidity change from high to low and from low to high. Thus, with respect to the environmental change, a proper correction displacement difference amount has a hysteresis. In such a case, the correction coefficient when the environmental humidity changes to increase and when the environmental humidity changes to decrease is set to be different.

In this example, the correction coefficient when the humidity is increasing is lower than that when the humidity is lowering. The actual correction amount is defined by a displacement amount [in mm] of the displacing member. For example, the correction amount when the humidity is increasing is 0 mm/RH10%. The correction amount when the humidity is lowering is 0.24 mm/RH10%. With this structure, as illustrated in FIG. 21, even when the humidity change of the displacement difference amount C with respect to the detected humidity is the same, the correction value is different, that is, when the humidity is increasing, the correction displacement difference amount becomes C2, and when the humidity is decreasing, the correction displacement difference amount becomes C3. According to the evaluation test, it is preferable to satisfy a relation that the correction amount during the humidity is increasing equals to or is lower than the correction amount during the humidity is lowering.

Next, an example of correction operation to be performed at a different timing will now be described.

Constant detection of the environmental condition change necessitates wasted power consumption for constant monitoring and detection operation in each and every control operation and is complicated.

Then, in a first example, the detection of environmental change and storing the displacement difference amount C are performed only before the liquid supply operation, because the fill-up position suitable for the negative pressure inside the head tank 35 may only be detected before the liquid supply operation. With this configuration, the control can be simplified.

In addition, when the head tank 35 has a slight negative pressure at the fill-up position and due to the variation in the correction value to the displacement difference amount corresponding to the environmental displacement amount, there is an occasion in which ink leakage occurs from the nozzle of the head 34 because the head tank 35 has a predetermined or more negative pressure or positive pressure when the normal amount of ink supply for the correction difference amount is performed.

Then, in a second example, correction of the displacement difference amount C in response to the environmental variation amount is to be performed only when the environmental condition is detected so that the negative pressure inside the head tank 35 is corrected to be strengthened when the liquid supply of the correction displacement difference amount C1 is performed rather than the displacement difference amount C. With this handling, it is prevented that the negative pressure inside the head tank 35 becomes more than the atmospheric pressure or more than the predetermined maximum negative pressure.

In addition, in the rapid environmental condition change, even though the environmental condition is detected, there is a case in which effect to the film 203 is not sufficient and change is negligible and with no change. In addition, the time taken for the film 203 to receive effect from the environmental condition change is different according to the shape and characteristic of the film 203.

Then, in a third example, correction of the displacement difference amount C corresponding to the environmental condition change is to be performed only when the environmental condition change is detected and that the detection result of the environmental condition of that time or the environmental condition change is maintained constant within a predetermined range.

Further, the film 203 suffers from stresses when liquid ink is supplied thereto and changes in its characteristic and shape over time. Then, there may be a possibility that the predetermined negative pressure range for the film 203 deviates from the first environmental change, the second environmental change, and the correction displacement difference amount obtained by the correction coefficient, which are correction control thresholds so far.

Therefore, in a fourth example, a sensor to detect a number of liquid supplies to the head tank 35 is provided. When a predetermined number of liquid supplies to the head tank 35 is detected, at least one of the first environmental change, second environmental change, and correction coefficient, which are thresholds to correct the displacement difference amount so far, is changed to a predetermined another value.

Thus, by changing the first environmental change, second environmental change, and correction coefficient after the predetermined number of liquid supplies has been detected, the negative pressure control of the head tank 35 in response to the environmental condition change can be stably performed over a long time of period.

Figure 22:
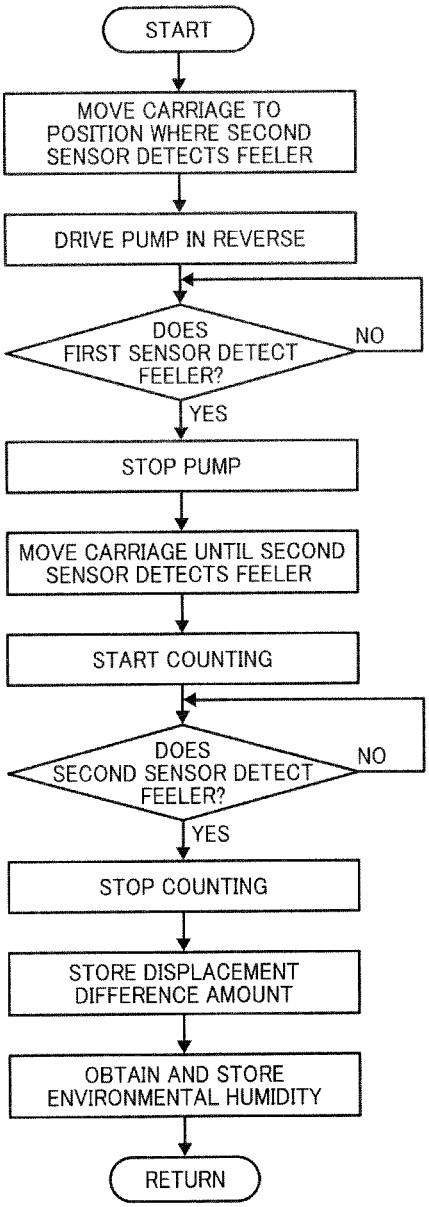
FIG. 22 is a flow chart illustrating a detection process of the difference amount including correction of the displacement difference amount performed by a controller according to the change in the environmental condition.
Figure 23:
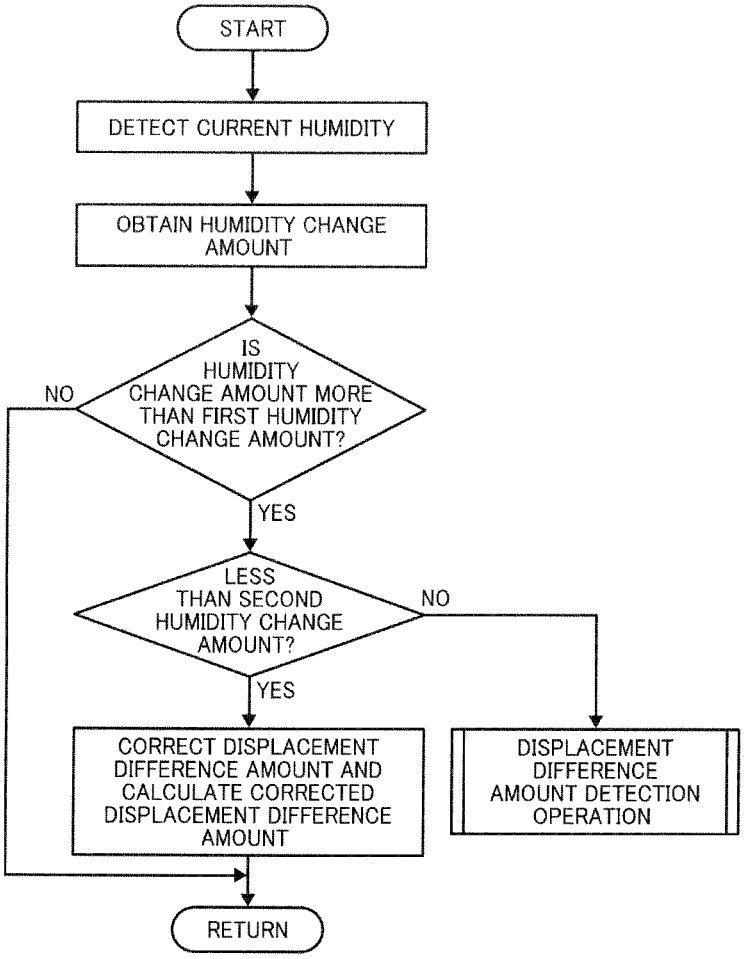
FIG. 23 is a flow chart illustrating difference amount correction process.
Figure 24:
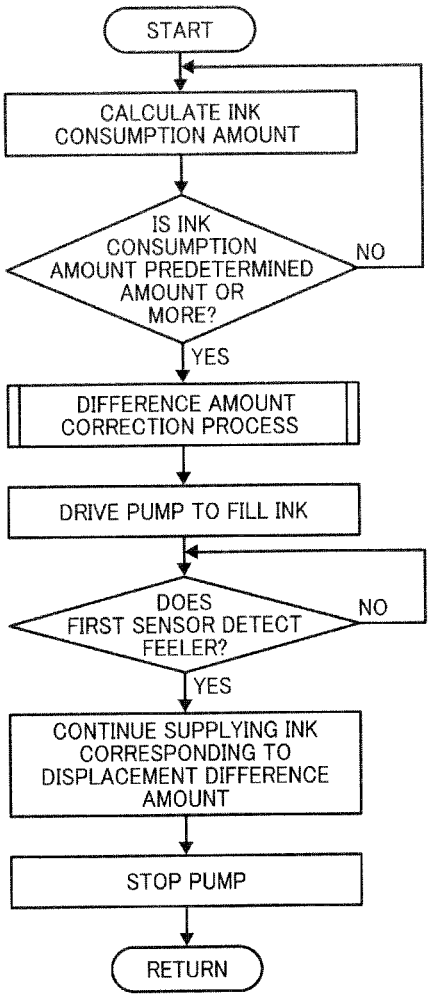
FIG. 24 is a flow chart illustrating an ink-filling process during printing.

FIGS. 22 through 24 are flowcharts each illustrating operations performed by the controller including correction of the displacement difference amount in response to the environmental condition change as described above.

First, in the displacement difference amount detection process as illustrated in FIG. 22, the displacement difference amount C is stored by the same processing described with reference to FIG. 14, and the environmental sensor 520 detects the environmental humidity and stores it in the memory.

Further, in the difference value correction process as illustrated in FIG. 23, humidity at present is detected, the change corresponding to the stored humidity is obtained, whether the obtained humidity change is more than the first environmental humidity change or not is determined, and if it is more than the first environmental humidity change, whether the obtained humidity change is less than the second environmental humidity change or not is determined.

When the obtained humidity change is less than the second environmental humidity change, the displacement difference amount C is corrected and a corrected displacement difference amount is calculated and stored. When the obtained humidity change exceeds the second environmental humidity change, the process moves to the process in FIG. 22 in which the displacement difference amount C is obtained and stored.

Next, in the filling up process during printing as illustrated in FIG. 24, when more than the predetermined amount of ink is consumed and ink needs to be supplied from the ink cartridge 10 to the head tank 35, the difference value correction process as described referring to FIG. 23 is performed. After filling the amount of ink corresponding to the displacement difference amount C or the obtained displacement difference amount C1 is performed, the fluid conveyance pump 241 is stopped. If in the difference value correction process, it is determined that the humidity change is more than the second environmental humidity change, the process moves to the process in FIG. 22 in which the displacement difference amount C is obtained and stored.

The control of the correction of the displacement difference amount in response to the environmental condition change may be in accordance with any of the first to third embodiments and the control of the correction of the displacement difference amount may be in accordance with any of the first to fourth examples.

Next, a description will be given of a fifth embodiment of the present invention. In the present fifth embodiment, the position of the displacing member is re-learned when a predetermined condition occurs.

First, a relation between the negative pressure inside the head tank and the consumed ink amount from the head tank will now be described referring to FIG. 25.

As explained with reference to FIG. 8, the negative pressure inside the head tank 35 has a proportional relation with the ink amount inside the head tank 35. When the ink amount inside the head tank 35 is large, (that is, when the consumed ink amount is small), the negative pressure inside the head tank 35 is small. When the ink amount is small (i.e., the consumed ink amount is large), the negative pressure inside the head tank 35 increases.

Then, the ink supply to the head tank 35 is controlled such that the ink amount ejected from the head tank 35 is within a consumed ink amount B in which the negative pressure inside the head tank 35 falls within a predetermined negative pressure control range A.

The consumed ink amount of the head tank 35 corresponding to a minimum value (with low negative pressure and small consumed ink amount) of the negative pressure control range A is an "ink supply upper limit position" with respect to the displacement position of the displacing member 205 (that is, an "ink supply upper limit amount" with respect to the ink amount). The consumed ink amount of the head tank 35 corresponding to a maximum value (with high negative pressure and large consumed ink amount) of the same range A is an "ink consumption lower limit position" with respect to the displacement position of the displacing member 205 (that is, an "ink consumption lower limit amount" with respect to the ink amount).

Figure 26:
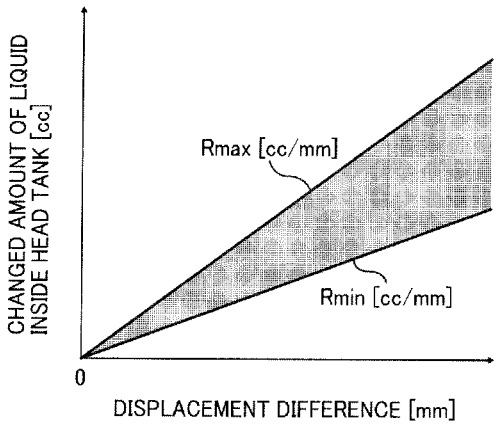
FIG. 26 is an explanatory view for explaining a relation between a changed amount of a liquid inside the head tank and a displacement amount of a displacing member.

Next, a relation between a changed amount of a liquid inside the head tank and a displacement amount of a displacing member will now be described with reference to FIG. 26.

If the liquid amount inside the head tank 35 changes, the displacing member 205 displaces. Here, from the characteristic of the head tank 35, because the displacement amount or distance of the displacing member 205 is not constant, a minimum displacement distance Rmin and a maximum displacement distance Rmax are previously set.

Because the displacing member 205 displaces in response to the liquid amount inside the head tank 35 or the consumed ink amount from the head tank 35, the consumed ink amount can be replaced with a "feeler displacement distance."

Figure 27:
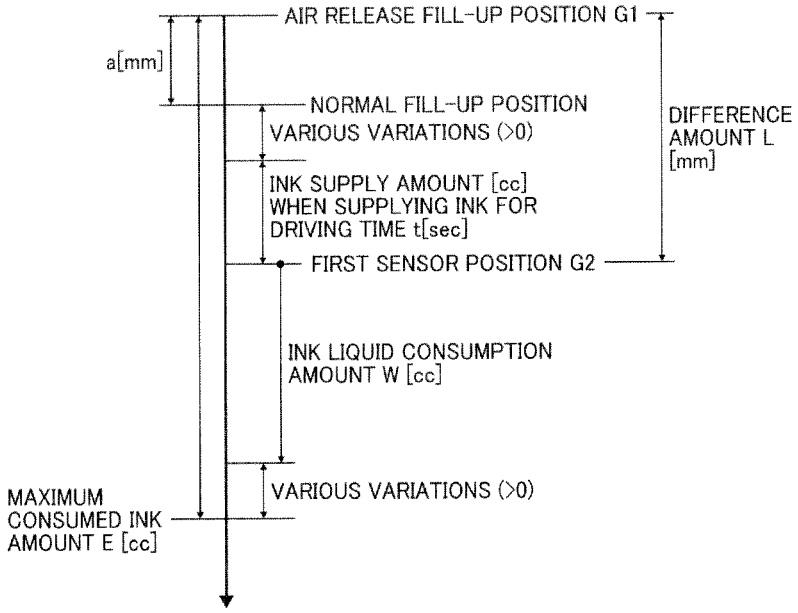
FIG. 27 is an explanatory view for explaining a relation between a consumed amount of ink inside the head tank and each position of the displacing member.

Next, a relation between a consumed amount of ink inside the head tank and each position of the displacing member will now be described with reference to FIG. 27.

Air release fill-up position (G1): When the head tank 35 is open to air, the film 203 of the head tank 35 displaces to expand outwardly. Then, the ink is filled while the head tank 35 being open to air, and the position of the displacing member 205 (or the position of the feeler) in which the ink is determined to be filled up by the electrode pins 208 is to be learned as the air release fill-up position "G1" at a necessary timing, which will be described later. The necessary timing means for example "after occurrence of paper jam in the main scanning", "after a long time has elapsed", and "when the humidity changes drastically."

Consumed ink amount inside the head tank [cc]: The consumed ink amount after a state in which the head tank 35 is filled up and shut off from the air is "pressure-convertible consumed ink amount in the head tank." If the head tank is open to air, the consumed ink amount inside the head tank as pressure corresponds to 0[cc] and the displacing member 205 displaces to a position corresponding to the air release fill-up position.

Normal fill-up position and predetermined distance a [mm]: A position apart from the air release fill-up position by a distance a [mm] is a normal fill-up position. As a predetermined distance a [mm], for example, a predetermined fixed value is used. Alternatively, a target negative pressure is sucked from the nozzle and the resulted difference of the displacing member 205 is obtained, and the thus obtained difference can be taken as a learned value.

The predetermined distance a [mm] is preferably set to such a value that the negative pressure inside the head tank 35 falls within a predetermined negative pressure control range A considering following variations.

Variations may include displacement amount of the displacing member 205 due to humidity change, pressure change inside the head tank due to temperature change, change errors of the displacing member 205 due to external pressure change, detection errors of the first sensor 251, fluctuation of displacing member 205, inertia fluid conveyance of the fluid conveyance pump 241 after stopping the pump 241, delayed fluid conveyance of the fluid conveyance pump 241, detection errors of the second sensor 301 to the apparatus body, the consumed ink amount error inside the head tank due to soft count errors of the amount of ink consumed, and the like.

First sensor position (G2) and difference amount L [mm]: The position observed by the second sensor 301 upon the first sensor 251 detecting the displacing member 205 is learned to be as the first sensor position "G2." In addition, the difference between the G1 and G2 is stored as "L[mm]."

Maximum consumed ink amount E[cc]: The maximum consumed ink amount E corresponds to the minimum value of the pressure range A of FIG. 25 or a value with a little margin than the minimum value of the pressure range A. Specifically, the maximum consumed ink amount E is the consumed ink amount from the ink amount of the air release filled up position to the ink consumption minimum value.

Liquid consumption amount (threshold) W [cc] and Maximum amount E [cc]: When the displacing member 205 displaces in a direction in which the ink amount inside the head tank 35 decreases as the ink amount inside the head tank 35 decreases during the printing operation, a consumed ink amount after the first sensor 251 has detected the displacing member 205 is calculated based on the soft count. Then, at a timing when the consumed ink amount reaches the liquid consumption amount (threshold) W [cc], filling of ink during printing starts. The threshold W [cc] is a value calculated when the difference amount L is stored and is obtained by the following formula 1.

$$W=(E-L\times R\text{max}-\Delta 2) \qquad \text{Formula 1}$$

wherein Δ2 is a fixed value obtained from the above variation.

Figure 25:
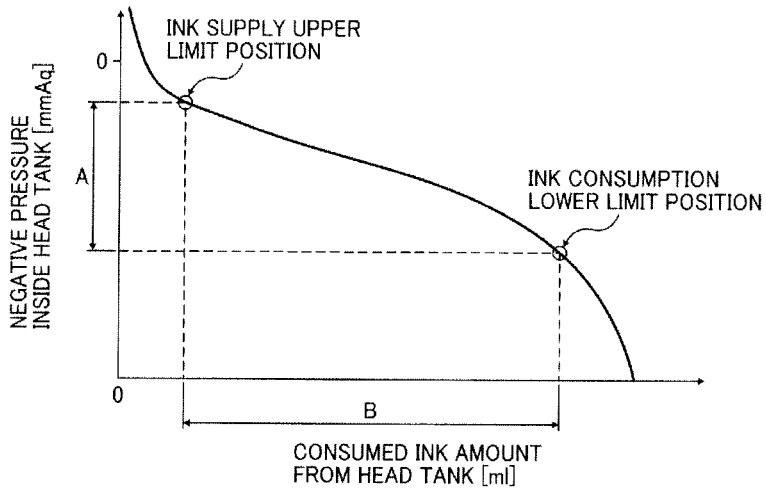
FIG. 25 is a view for explaining a relation between a negative pressure inside the head tank and an amount of consumed ink from the head tank according to a fifth embodiment of the present invention.

As the formula 1 considers variations, the pressure inside the head tank when ink has consumed up to the threshold W [cc] is set within the pressure range A in FIG. 25. Further, E=L+W stands from part of the formula 1. Then, the ink supply can be started in a state nearest to E-value (and as close as to the minimum value of the pressure range A in FIG. 25 (or the ink consumption minimum value)).

Driving time (difference supply time) t [sec]: After starting of supply ink during printing, ink is supplied for a driving time t [sec] from when the first sensor 251 detects the displacing member 205 during the ink supply. The driving time t [sec] is a supply period of the fluid conveyance pump 241 corresponding to the difference value when the L-value is stored. The driving time t is represented by a following formula 2:

$$t=(L-a-\Delta 1)\times R\text{min}/Q\text{max} \qquad \text{Formula 2}$$

wherein Δ1 is a fixed value obtained from the above variation; and Qmax is fluid conveyance maximum performance (fixed value).

As the formula 2 considers variations, the pressure inside the head tank after ink has supplied for the driving time t [sec] is set within the pressure range A in FIG. 25. Further, L-a is taken from part of the formula 2. Then, the ink supply during the printing operation can be completed with a filled up amount as close as to the normal fill-up position (or the ink supply upper limit amount).

Figure 28:
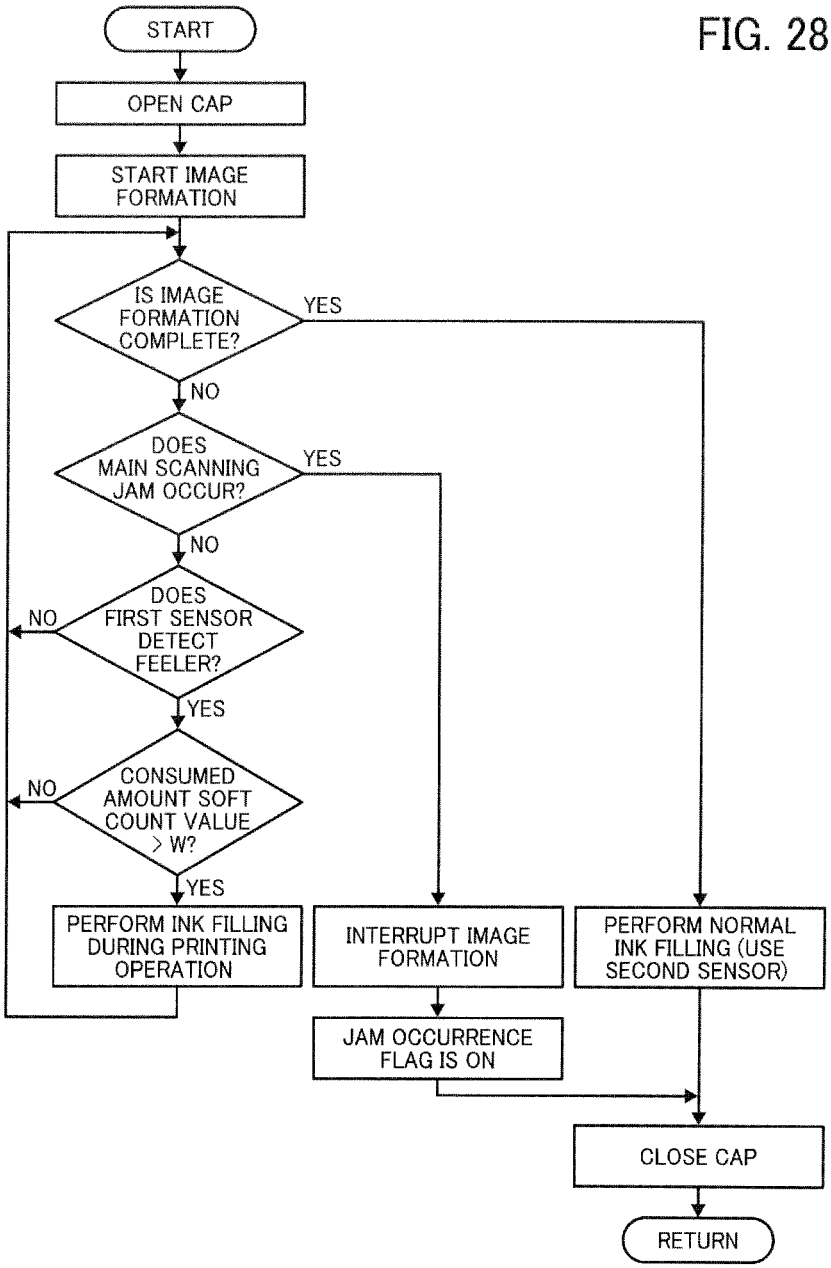
FIG. 28 is a flowchart illustrating an image forming operation after a print command.

Next, an image forming operation after a printing command in the present embodiment will now be described with reference to FIG. 28.

Upon receipt of a printing command, the cap 82 of the maintenance mechanism 81 is removed from the nozzle surface and the image formation starts. Then, whether the image formation has been completed or not is determined Herein, when the image formation has not been completed yet, whether a jam has occurred or not in the main scanning operation is determined When it is determined that the jam has occurred, the image formation is terminated and a flag of jam occurrence is on.

If no jam occurs, whether the first sensor 251 has detected the displacing member 205 or not is determined (The first sensor feeler detection) Then, when the first sensor feeler detection occurs, whether the soft count value of the amount of ink consumed after feeler detection exceeds the threshold W or not is determined. When it is determined that the amount of ink consumed after feeler detection exceeds the threshold W, supplying ink during printing starts. Thus, while the image formation is being continued, filling of ink to the head tank 35 is performed.

By contrast, when the image formation has completed, normal filling is performed. The normal filling is the filling using the second sensor 301.

Thereafter, the nozzle surface of the print head 34 is capped with the cap 82.

Figure 29:
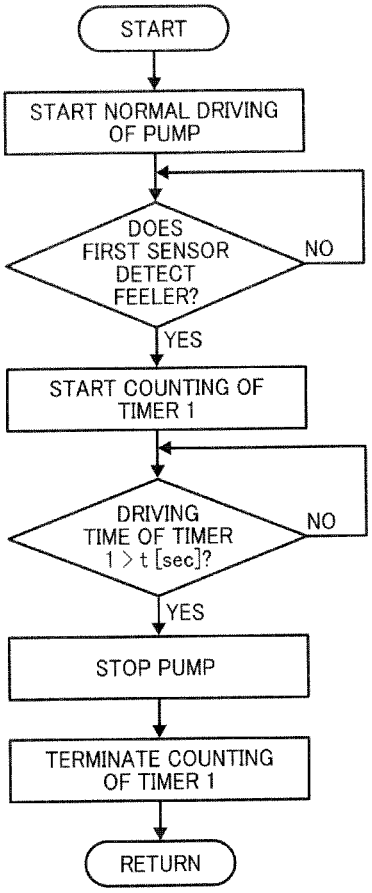
FIG. 29 is a flowchart illustrating an ink-filling process during printing.

Next, a filling operation during printing according to the present embodiment will now be described with reference to FIG. 29.

First, a normal driving of the fluid conveyance pump 241 is started and the ink is conveyed to the head tank 35. Then, whether the first sensor 251 detects the displacing member 205 or not is determined.

When the first sensor 251 detects the displacing member 205, counting of a timer 1 starts. Then, whether the count value of the timer 1 exceeds the driving time t [sec] or not is determined.

Here, when the count value of the timer 1 exceeds the driving time t [sec], the driving of the fluid conveyance pump 241 is stopped and the counting of the timer 1 terminates. The position of the displacing member 205 shows a state close to the normal fill-up position.

Figure 30:
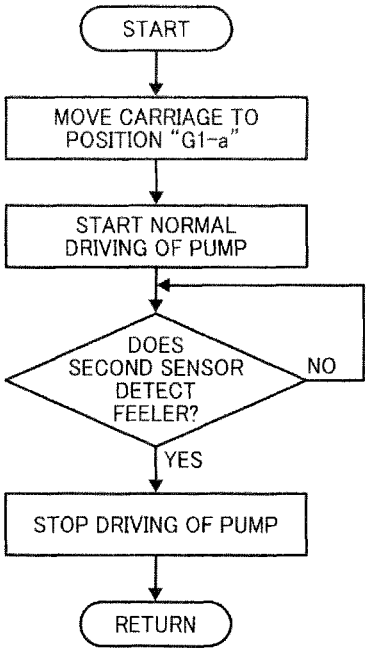
FIG. 30 is a flowchart illustrating a normal ink-filling process.

Next, a normal filling operation according to the present embodiment will now be described with reference to a flowchart in FIG. 30.

First, the carriage 33 is moved to a position G1-a (that is, the air release fill-up position minus a predetermined distance), and the ink is conveyed to the head tank 35 via the fluid conveyance pump 241.

Then, upon the second sensor 301 has detected the displacing member 205, the fluid conveyance pump 241 is stopped. With this operation, the position of the displacing member 205 is at the normal fill-up position.

Figure 31:
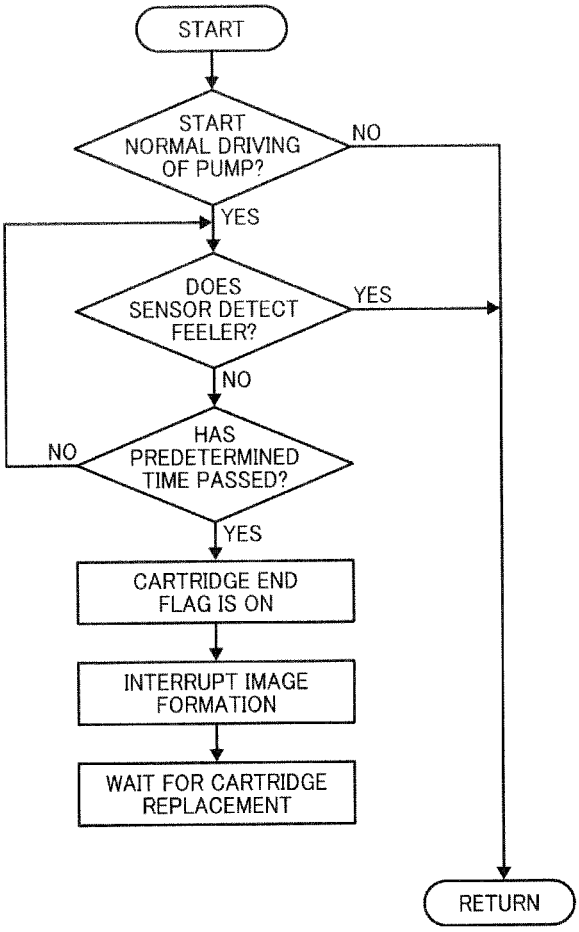
FIG. 31 is a flowchart illustrating a cartridge end determination process.

In the above-described filling process during printing and normal filling process, to determine that the ink in the main tank 10 is consumed up, as illustrated in FIG. 31, when the first sensor 251 or the second sensor 301 does not detect the displacing member 205 even after a predetermined time has passed after driving of the fluid conveyance pump 241 started, it is determined that the main tank 10 has become empty and a cartridge end flag is on and the process moves to the cartridge replacement waiting.

As described above, when during the printing operation, the displacing member 205 of the head tank 35, the carriage 33 along with the first sensor 251 perform jointly the filling control, if the relation between the displacement amount of the displacing member 205 and the negative pressure inside the head tank 35 is deviated, the negative pressure control becomes unstable.

For example, due to the environmental change of the environmental temperature and humidity, the film 203 of the head tank 35 expands or shrinks and the relation between the negative pressure inside the head tank and the displacement amount of the displacing member 205 changes. In addition, when the main scanning jam occurring due to interference of the carriage with the sheet occurs, the displacing member 205 of the head tank 35 may be damaged to thus change the displacement amount of the displacing member 205, resulting in change of the relation between the negative pressure inside the head tank and the displacement amount of the displacing member 205.

Further, deterioration of the displacing member 205 and the film 203 over time and accumulated external vibration may change the relation between the displacement amount of the displacing member 205 and the negative pressure inside the head tank. In addition, when fluid conveyance is performed to the head tank 35 in a state in which the ink cartridge is empty (i.e., the main tank end state), a great deal of ink has been consumed in the head tank 35. Such a state changes the relation between the displacement amount of the displacing member 205 and the negative pressure inside the head tank 35.

Thus, when the relation between the displacement amount of the displacing member 205 and the negative pressure inside the head tank 35 is changed, even the filling operation during printing is performed using the displacing member 205, a proper ink supply cannot be performed and the negative pressure control inside the head tank 35 becomes unstable. That is, the negative pressure control within the negative pressure control range A is not impossible.

Accordingly, in the present embodiment, when a condition in which the negative pressure control inside the head tank becomes unstable occurs, the position of the displacing member or the feeler is re-learned. Specifically, the threshold W of the amount of ink consumed required to perform ink-filling control during printing and the driving time t to drive the fluid conveyance pump 241 corresponding to the displacement difference amount are reset and stored.

Figure 32:
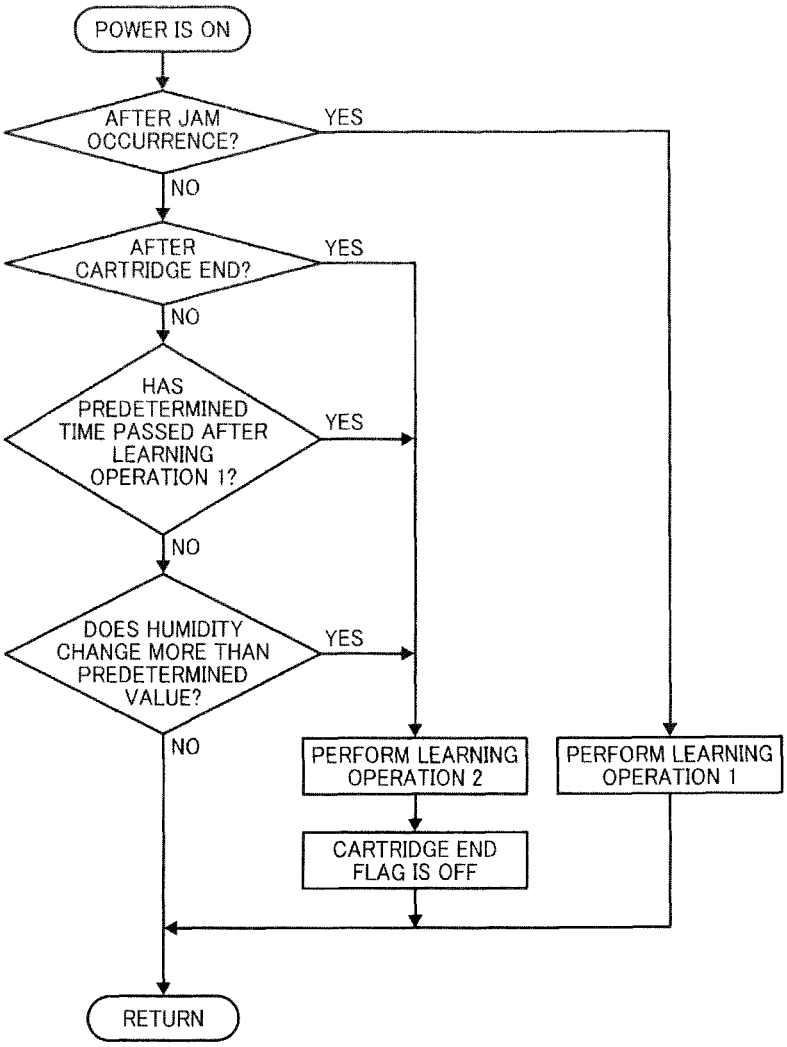
FIG. 32 is a flowchart illustrating steps in a relearning operation.

First, an overall flow of a feeler position re-learning will now be described with reference to FIG. 32.

When the power is turned on, the jam occurrence flag is checked and whether the power is turned on after the jam occurrence or not is determined. In this case, when the power is on after the occurrence of a jam, a learning operation 1 (which will be described later) is performed to relearn the position of the feeler (i.e., the position of the displacing member 205) and the driving time t [sec] is reset, and the jam occurrence flag is removed.

When the power is not turned on after the jam occurrence, the cartridge end flag is checked and whether the power is turned on after the cartridge end or not is determined. In this case, when the power is on after the cartridge end, a learning operation 2 (which will be described later) is performed to relearn the position of the feeler (i.e., the position of the displacing member 205) and the driving time t [sec] is reset, and the cartridge end flag is removed.

When the power is not turned on after the cartridge end, whether a predetermined time has passed or not after having performed the learning operation 1 is determined In this case, when the predetermined time has passed after having performed the learning operation 1, the learning operation 2 (which will be described later) is performed to relearn the position of the feeler (i.e., the position of the displacing member 205) and the driving time t [sec] is reset. In the illustrated example, the cartridge end flag can be removed in this case, but can be omitted in this case.

When a predetermined time has not elapsed after having performed the learning operation 1, whether the current humidity is deviated more than the predetermined value relative to the humidity when the learning operation 1 or the learning operation 2 was performed. In this case, if the current humidity is deviated more than a predetermined value relative to the humidity in the previous learning, the learning operation 2 is performed and the position of the feeler or the displacing member 205 is relearned, and the driving time t [sec] is reset. In the illustrated example, the cartridge end flag can be removed in this case, but this operation can be omitted in this case.

Figure 33:
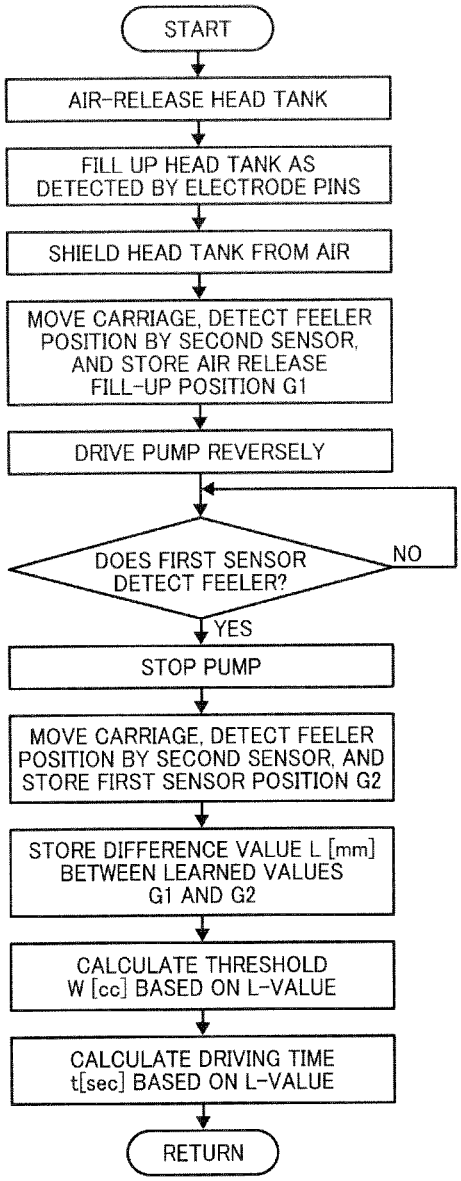
FIG. 33 is a flowchart illustrating a learning operation 1.

Next, the learning operation 1 will be described with reference to a flowchart in FIG. 33.

First, the head tank 35 is brought into the air release state. After the head tank 35 is filled with ink so that the electrode pins 208 detect that the tank is full, the head tank 35 is shielded from air.

Then, the carriage 33 is moved and the position of the carriage 33 when the second sensor 301 detects the displacing member 205 is read as a position of the feeler, and the air release fill-up position G1 is stored.

Then, the fluid conveyance pump 241 is reversely driven to convey the ink from the head tank 35 to the main tank 10 reversely, and whether the first sensor 251 has detected the displacing member 205 or not is determined. When the first sensor 251 has detected the displacing member 205, the fluid conveyance pump 241 is stopped.

Then, the carriage 33 is moved, and the position of the carriage when the second sensor 301 has detected the displacing member 205 is the position of feeler, which is stored as the first sensor position G2.

Then, the difference amount L (L-value) [mm] between the air release fill-up position G1 and the first sensor position G2 is stored.

Based on the L-value, the threshold W [cc] and the driving time t [sec] are calculated and stored.

Figure 34:
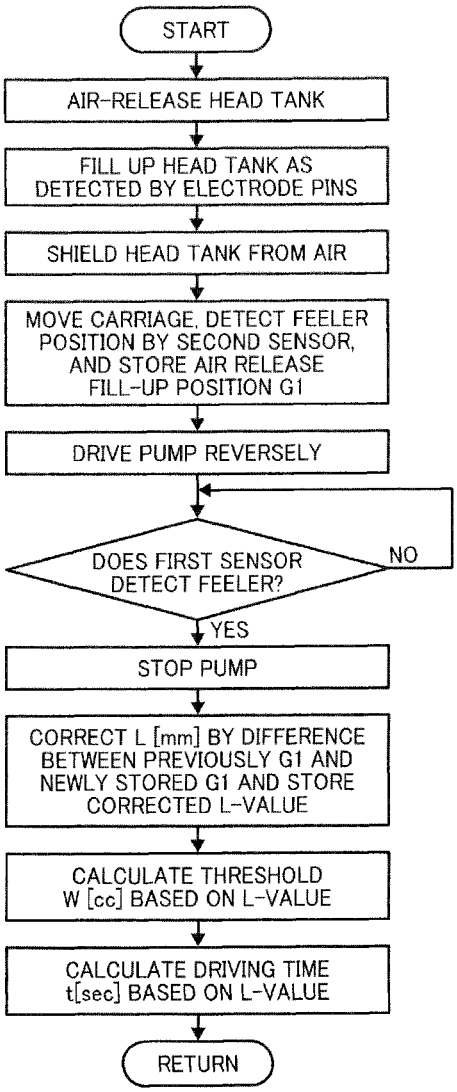
FIG. 34 is a flowchart illustrating a learning operation 2.

Next, the learning operation 2 will be described with reference to a flowchart in FIG. 34.

First, the head tank 35 is brought into the air release state. After the head tank 35 is filled with ink so that the electrode pins 208 detect that the tank is full, the head tank 35 is shielded from the air.

Then, the carriage 33 is moved and the position of the carriage 33 when the second sensor 301 detects the displacing member 205 is read as a position of the feeler, and the air release fill-up position G1 is stored.

Then, the fluid conveyance pump 241 is reversely driven to convey the ink from the head tank 35 to the main tank 10 reversely, and whether the first sensor 251 has detected the displacing member 205 or not is determined. When the first sensor 251 has detected the displacing member 205, the fluid conveyance pump 241 is stopped.

Then, the difference between the air release fill-up position G1 stored in the previous time and the air release fill-up position G1 stored this time is calculated. From the calculated difference, the difference value L (L-value) [mm] stored in the previous time is corrected and stored.

Based on the L-value, the threshold W [cc] and the driving time t [sec] are calculated and stored.

Specifically, the learning operation 2 is different from the learning operation 1 because the L-value is calculated and stored without moving the carriage 33 after the first sensor 251 detects the displacing member 205. Accordingly, the learning operation 2 can reduce the time required for relearning than the learning operation 1.

The reason why the leaning operations 1 and 2 are selectively used in the following relearning occurrence conditions including (1) After jam occurrence; (2) After cartridge end; (3) After a predetermined time has elapsed; and (4) Humidity change is as follows. (1) After occurrence or removal of a jam, it is assumed that an obstacle such as a sheet abuts the displacing member 205 and the position of the feeler (including the air release fill-up position G1) is deviated. Due to any contact to the first sensor 251 on the carriage 33, the first sensor position G2 may be deviated. Then, the learning operation 1 is performed to relearn the air release fill-up position G1 and the first sensor position G2. (2) That the ink filling operation is performed during printing after the cartridge end means that the ink supply is performed from the empty main tank 10. Because the ink is not supplied actually, an interior of the head tank 35 may have an excessive negative pressure due to the ink consumption by printing, for example. In a state in which the head tank 35 has an excessive negative pressure and is shielded from air, when the ink is supplied from a new main tank 10 to the head tank 35, it is assumed that the feeler's displacement characteristic of the displacing member 205 changes around the end of the main tank 10 and the air release fill-up position G1 is deviated. By contrast, the first sensor position G2 is fixed and it is assumed that the position G2 is not changed. Then, the learning operation 2 is sufficient to relearn the air release fill-up position G1 and is performed. (3) Due to the degeneration of the displacing member 205 and the film 203 after more than the predetermined time has passed and due to accumulated external vibrations, it is assumed that the displacement characteristic of the displacing member 205 changes and the air release fill-up position G1 is deviated. By contrast, the first sensor position G2 is fixed and it is assumed that the position G2 is not changed. Then, the learning operation 2 is sufficient to relearn the air release fill-up position G1 and is performed. (4) Due to the environmental change such as humidity change, the film 203 expands and shrinks, and it is assumed that the displacement characteristic of the displacing member 205 changes and the air release fill-up position G1 is deviated. By contrast, the first sensor position G2 is fixed and it is assumed that the position G2 is not changed. Then, the learning operation 2 is sufficient to relearn the air release fill-up position G1 and is performed.

As described above, when there is a possibility that the displacement amount of the displacing member 205 changes, the negative pressure inside the head tank is stabled by being controlled by relearning.

In the present embodiments, the leaning operation 1 and the learning operation 2 are provided in accordance with the relearning requirement condition. However, it is configured to perform the same relearning operation (for example, either the learning operation 1 or the learning operation 2) when the relearning requirement condition arises.

The ink supplying operation to the head tank is controlled by the computer via the program stored in the ROM 502. The program is installed in the image forming apparatus by downloading to the host computer 600 as an information processor. In addition, by using the image forming apparatus according to the present embodiment and an information processor or the image forming apparatus and an information processor having a program allowing processing according to the present invention to perform in combination, an image forming system may be configured.

In this patent specification, "sheet" is not limited to the paper material, but also includes an OHP sheet, fabrics, boards, etc., on which ink droplets or other liquid are deposited. The term "sheet" is a collective term for a recorded medium, recording medium, recording sheet, and the like.

The term "image forming apparatus" means a device for forming an image by impacting ink droplets to media such as paper, thread, fiber, fabric, leather, metals, plastics, glass, wood, ceramics and the like. "Image formation" means not only forming images with letters or figures having meaning to the medium, but also forming images without meaning such as patterns to the medium (and impacting the droplets to the medium).

The ink is not limited to so-called ink, but means and is used as an inclusive term for every liquid such as recording liquid, fixing liquid, and aqueous fluid to be used for image formation, which further includes, for example, DNA samples, registration and pattern materials and resins.

The image is not limited to a plane two-dimensional one, but also includes a three-dimensional one, and the image formed by three-dimensionally from the 3D figure itself.

Further, the image forming apparatus includes, otherwise limited in particular, any of a serial-type image forming apparatus and a line-type image forming apparatus.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a print head to discharge liquid droplets;

a head tank to contain a liquid to be supplied to the print head;

a carriage mounting the print head and the head tank thereon;

a main tank to contain a liquid to be supplied to the head tank;

a pump to convey the liquid from the main tank to the head tank;

a displaceable member disposed on the head tank and displacing in response to an amount of the liquid remaining inside the head tank;

a first sensor disposed at the carriage and detecting the displaceable member at a predetermined first position;

a second sensor disposed outside the carriage at the apparatus and detecting the displaceable member at a predetermined second position different from the first position, the first position being a position in which the amount of the liquid remaining in the head tank is less than at the second position;

a controller to detect and store a displacement difference amount corresponding to a displacement amount of the displaceable member between the position detected by the first sensor and the position detected by the second sensor and to supply an amount of liquid corresponding to the displacement difference amount to the head tank from the main tank, when the liquid is supplied from the main tank to the head tank without using the second sensor after the first sensor detects the displaceable member; and an environmental condition detector to detect an environmental condition in which the apparatus is disposed, the controller being configured to:

store the environmental condition detected when the displacement difference amount is stored;

calculate and correct the stored displacement difference amount by using a predetermined coefficient, corresponding to the detected environmental condition, without detecting a new displacement difference amount, when a change in a current environmental condition relative to the stored environmental condition is more than a first preset threshold but less than a second preset threshold larger than the first threshold; and detect and store another displacement difference amount without correcting the stored displacement difference amount, when the change in the current environmental condition relative to the stored environmental condition exceeds the second threshold.

2. The image forming apparatus as claimed in claim 1, wherein the correction of the displacement difference amount is performed in response to a current environmental condition.

3. The image forming apparatus as claimed in claim 1, wherein the coefficient used to correct the displacement difference amount varies depending on whether the current environmental condition is higher or lower than the stored environmental condition.

4. The image forming apparatus as claimed in claim 1, wherein the correction of the displacement difference amount is performed only before a liquid supplying operation from the main tank to the head tank corresponding to the displacement difference amount.

5. The image forming apparatus as claimed in claim 1, wherein the correction of the displacement difference amount s performed only when both conditions a) and b) are satisfied:

a) during the liquid supplying operation from the main tank to the head tank corresponding to the displacement difference amount and;

b) when the environmental condition is such that negative pressure inside the head tank when the liquid supply corresponding to the displacement difference amount after the correction being performed becomes higher than the negative pressure inside the head tank when the liquid supply corresponding to the stored displacement difference amount being performed.

6. The image forming apparatus as claimed in claim 1, wherein the correction of the displacement difference amount is performed when the change in the environmental condition continues for more than a predetermined time period and remains within a predetermined range.

7. The image forming apparatus as claimed in claim 1, wherein the environmental condition is at least one of temperature and humidity.

8. The image forming apparatus as claimed in claim 1, further comprising:

a sensor to detect a number of liquid supplies to the head tank; and a changing unit to change either the first threshold, the second threshold, or the coefficient used to correct the displacement difference amount when the sensor detects that a predetermined number of liquid supplies to the head tank is performed.

9. The image forming apparatus as claimed in claim 1, wherein the displacement difference amount is stored as the displacement difference amount itself, a conveyed liquid amount corresponding to the displacement difference amount, or a driving time of the pump corresponding to the displacement difference amount.

10. The image forming apparatus as claimed in claim 1, further comprising:

a liquid supply system controller to drive the pump to control a liquid supply from the main tank to the head tank;

wherein the liquid supply system controller is configured to detect and store the displacement difference amount n a case in which power to the apparatus is turned on after occurrence of a jam, a predetermined time has elapsed after the displacement difference amount is detected and stored, the main tank is replaced, or current environmental humidity is deviated more than a predetermined value previously set for the environmental humidity when the displacement difference amount is detected and stored.

11. The image forming apparatus as claimed in claim 10, wherein when the power to the apparatus is turned on after occurrence of the jam, an air release fill-up position of the displaceable member in which the air is released from the head tank and the liquid is filled up, and a position that the first sensor detects the displaceable member by discharging the liquid from the filled-up state head tank are respectively obtained and the displacement difference amount is obtained.

12. The image forming apparatus as claimed in claim 10, wherein when the predetermined time has elapsed after the displacement difference amount is detected and stored, the main tank is replaced, or the current environmental humidity is deviated more than the predetermined value previously set for the environmental humidity When the displacement difference amount is detected and stored, an air release fill-up position of the displaceable member in which the air s released from the head tank and the liquid is filled up is obtained, and the displacement difference amount is corrected by a difference value between the newly obtained air release fill-up position and the stored air release position.

13. The image forming apparatus as claimed in claim 10, the displacement difference amount is stored as the displacement difference amount itself, a conveyed liquid amount corresponding to the displacement difference amount, or a driving time of the pump corresponding to the displacement difference amount.

* * * * *